US012582229B2

(12) United States Patent
Kudernatsch et al.

(10) Patent No.: US 12,582,229 B2
(45) Date of Patent: Mar. 24, 2026

(54) ACTIVE CHAIR

(71) Applicant: Advanced Biomechanical Solutions LLC, Wilmington, DE (US)

(72) Inventors: Simon Kudernatsch, West Hartford, CT (US); Tanimu Deleon, Mystic, CT (US)

(73) Assignee: Advanced Biomechanical Solutions, LLC, Wilmington, DE (US)

( * ) Notice: Subject to any disclaimer, the term of this patent is extended or adjusted under 35 U.S.C. 154(b) by 246 days.

(21) Appl. No.: 18/625,470

(22) Filed: Apr. 3, 2024

(65) Prior Publication Data

US 2024/0381998 A1 Nov. 21, 2024

Related U.S. Application Data

(60) Provisional application No. 63/502,127, filed on May 15, 2023.

(51) Int. Cl.

| | |
|---|---|
| ***A47C 1/023*** | (2006.01) |
| ***A47C 3/30*** | (2006.01) |
| ***A47C 7/00*** | (2006.01) |

(52) U.S. Cl.

CPC ..... *A47C 1/023* (2013.01); *A47C 3/30* (2013.01); *A47C 7/004* (2013.01)

(58) Field of Classification Search

CPC ..... A47C 1/023; A47C 3/30; A47C 7/004; A47C 7/441; A47C 7/448; A47C 9/002; B60N 2/062; B60N 2/045; B60N 2/06

See application file for complete search history.

(56) References Cited

U.S. PATENT DOCUMENTS

| | | | | |
|---|---|---|---|---|
| 4,860,733 | A | 8/1989 | Parker et al. | |
| 4,986,260 | A | 1/1991 | Iams et al. | |
| 5,437,609 | A | 8/1995 | Leonard et al. | |
| 5,590,930 | A | 1/1997 | Glockl | |
| 5,624,383 | A | 4/1997 | Hazard et al. | |
| 5,755,650 | A | 5/1998 | Urso | |
| 6,033,021 | A | 3/2000 | Udo et al. | |
| 6,488,640 | B2 | 12/2002 | Hood, Jr. et al. | |
| 6,685,268 | B2 | 2/2004 | Meyer | |
| 6,866,340 | B1 | 3/2005 | Robertshaw | |
| 7,338,125 | B2 | 3/2008 | Grabowski | |
| 9,101,217 | B2 | 8/2015 | Bay | |
| 9,827,161 | B2 | 11/2017 | Ruf | |
| 10,076,975 | B2 * | 9/2018 | Jacobson | B60N 2/146 |
| 10,130,835 | B1 | 11/2018 | Leonard | |
| 10,765,582 | B2 | 9/2020 | Halperin | |
| 2006/0108848 | A1 * | 5/2006 | Williamson | A47C 3/18 297/344.24 |
| 2009/0230743 | A1 | 9/2009 | Derakhshan et al. | |
| 2011/0298240 | A1 * | 12/2011 | Jaranson | B60N 3/06 297/452.1 |
| 2013/0169016 | A1 | 7/2013 | Meyuhas | |

* cited by examiner

*Primary Examiner* — Magdalena Topolski
*Assistant Examiner* — Vicente Rodriguez
(74) *Attorney, Agent, or Firm* — McHale & Slavin, P.A.

(57) ABSTRACT

An active chair having a mechanism that allows the chair to move the seat linearly either right or left, front or back or in combination of the two reaching any point within the movement boundary established by the limits of the mechanism. Tension can be applied to resist the movement or the movement can be stopped all together. Tracking of dynamic movements of the chair is through a smartphone software application which can recommend the next time when the occupant should move again.

18 Claims, 46 Drawing Sheets

ACTIVE CHAIR

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 63/502,127, entitled "ACTIVE CHAIR", filed May 15, 2023. The contents of the above referenced application are incorporated herein by reference in its entirety.

FIELD OF THE INVENTION

This invention is directed to the furniture field and, in particular, to an active chair.

BACKGROUND OF THE INVENTION

With the dawn of the information age, occupations shifted a more dynamic workforce to a more sedentary workforce. During the industrial age, physical activity by the masses tended to happen while working—in essence from the manual nature of the work. This shift in how civilized society works is now accelerating the risk of cardiovascular disease, muscle atrophy, and joint and muscle aches. The confounding factor is that when the workforce is not at work, they are typically at home, doing what else-sitting. An analysis of several studies found that sitting for more than eight hours a day posed the same risk of early death as from obesity and smoking. As a result, there have been numerous seat technologies that espouse the dynamic nature of the seat.

Some of these technologies are medicine ball seats, sit/stand desks, treadmill desks, and backless seats to promote sitting with a proper posture to name a few. All these technologies fall under the auspices of a term called Ergonomics. As of late, these technologies add the term ergonomics to the name of the product and a new market is formed to combat societies epidemic of sitting.

The issue with the offerings in the ergonomic seating market, is that some of the technologies are uncomfortable (i.e., medicine ball seat), most technologies do not move the occupant of the seat, some of which can cause indirect harm to the occupant.

What other chairs lack, the instant invention makes up for in abundance by incorporating comfort and dynamic movement which activates the core muscles (abdominals and erector spinae) of the human torso, and all while leveraging the basic concept of an ergonomic office chair.

PRIOR ART

Known prior art disclosing chairs that claim to provide more than just the mechanics of sitting include: U.S. Pat. No. 9,101,217-Ergonomic Göbelek chair; U.S. Pat. No. 10,765,582-Apparatus for stimulating synchronized body motions of a User; U.S. Pat. No. 10,130,835-Three exercise combination device to alleviate sciatica and low back pain; U.S. Pat. No. 9,827,161-Chair for relieving back pain; US20130169016-Natural balance active chair; US20090230743-Rehabilitative exercising chair; U.S. Pat. No. 7,338,125-Rehabilitative and recreational armchair; U.S. Pat. No. 6,685,268-Seat arrangement for sitting furniture; U.S. Pat. No. 6,866,340-Spinal glide ergonomic chair seat and pelvic stabilizer; U.S. Pat. No. 6,488,640-Method and device for continuous passive lumbar motion (CLMP) for back exercise; U.S. Pat. No. 6,033,021-Chair having automatic adjustable cycle seat; U.S. Pat. No. 5,755,650-Home and office health and fitness chair; U.S. Pat. No. 5,624,383-Method of and means for providing force feedback in continuous passive motion systems; U.S. Pat. No. 5,437,609-Chiropractic articulating traction chair; U.S. Pat. No. 5,590,930-Active dynamic seat; U.S. Pat. No. 4,860,733-Oscillating reclining chair; U.S. Pat. No. 4,986,260-Apparatus and method for providing continuous passive motion to the spine.

The prior references use basic spring mechanics, incline and decline mechanics, or a combination of both to either rehabilitate or provide a type of dynamic movement.

SUMMARY OF THE INVENTION

Disclosed is an active chair resembling a commercially available office chair with a improved mechanism that allows the chair to move the seat linearly either right or left, front or back or in combination of the two reaching any point within the movement boundary established by the limits of the mechanism. Tension can be applied to resist the movement, or the movement can be stopped all together wherein the chair operates as a conventional inactive chair. Conventional telescoping features, seat base tilt with lock, backrest decline, and mobility to different waypoints inside remain the same. The Applicant's mechanism can also track of the dynamic movements of the chair via a smartphone software application providing feedback that recommends a time period for the occupant to move.

Other objectives and advantages of this invention will become apparent from the description taken following in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE PREFERRED EMBODIMENT

Figure 1:
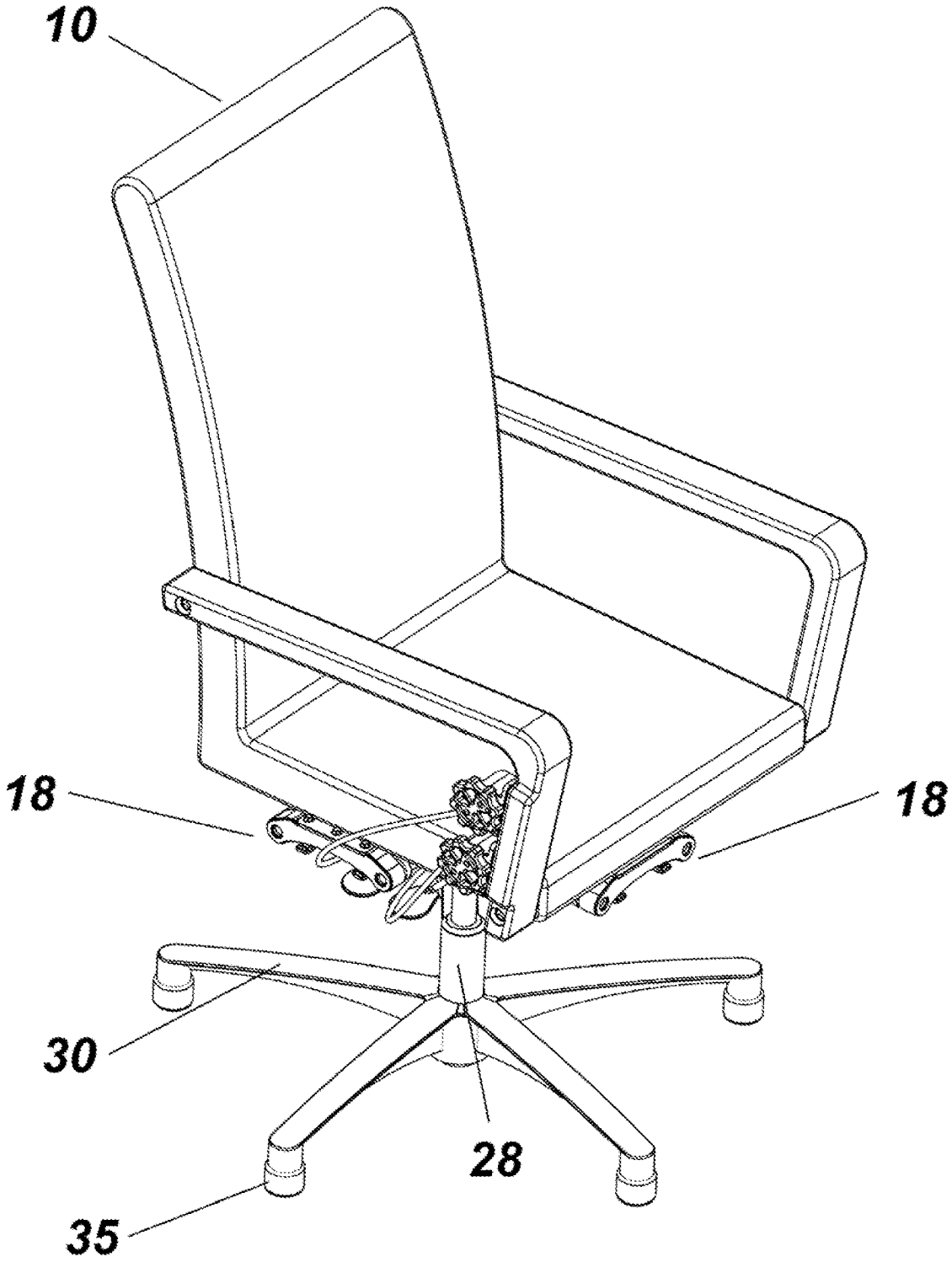
FIG. 1 is a top perspective view of the active chair in neutral position.
Figure 2:
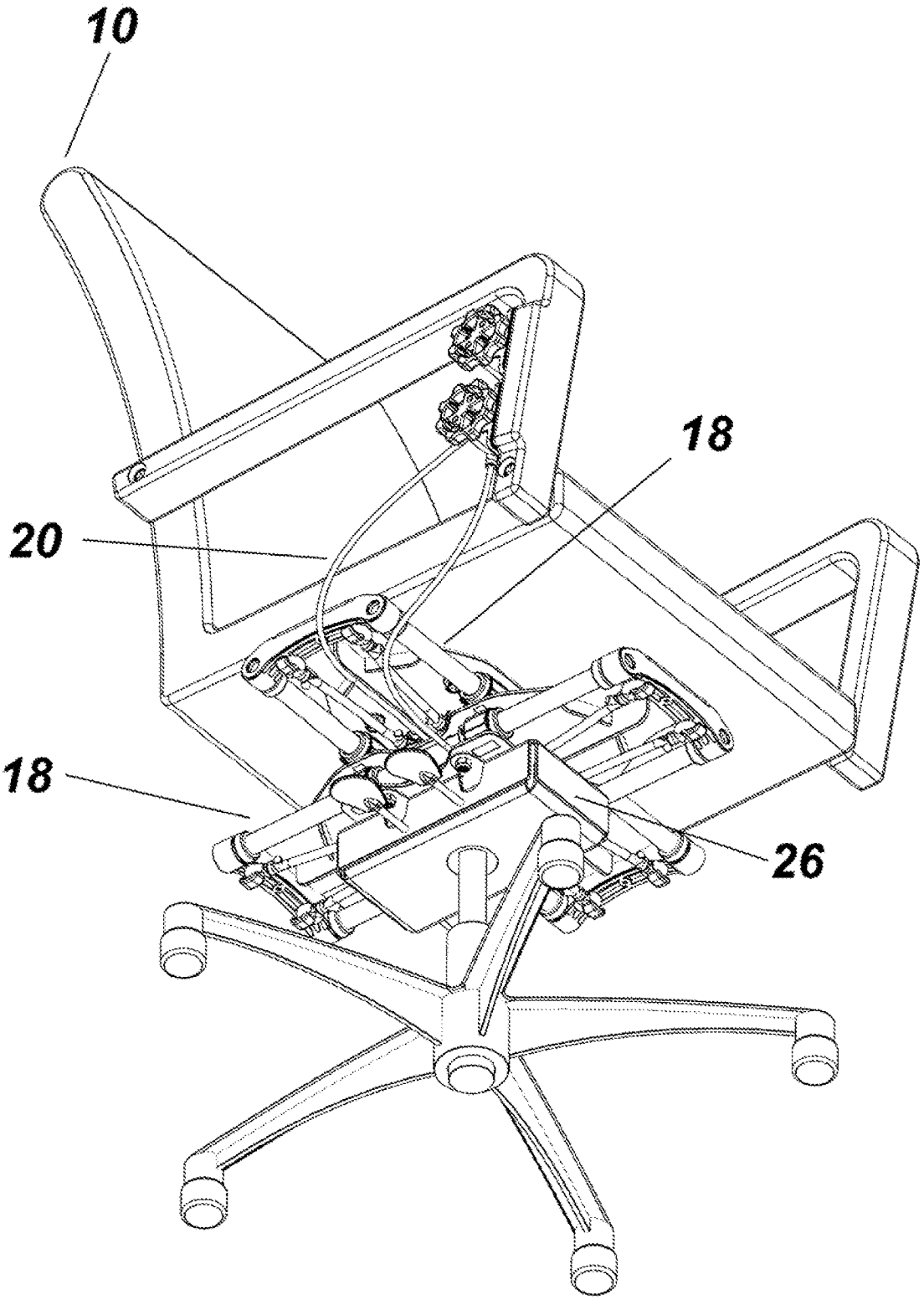
FIG. 2 is a bottom perspective view of the active chair in neutral position.
Figure 3:
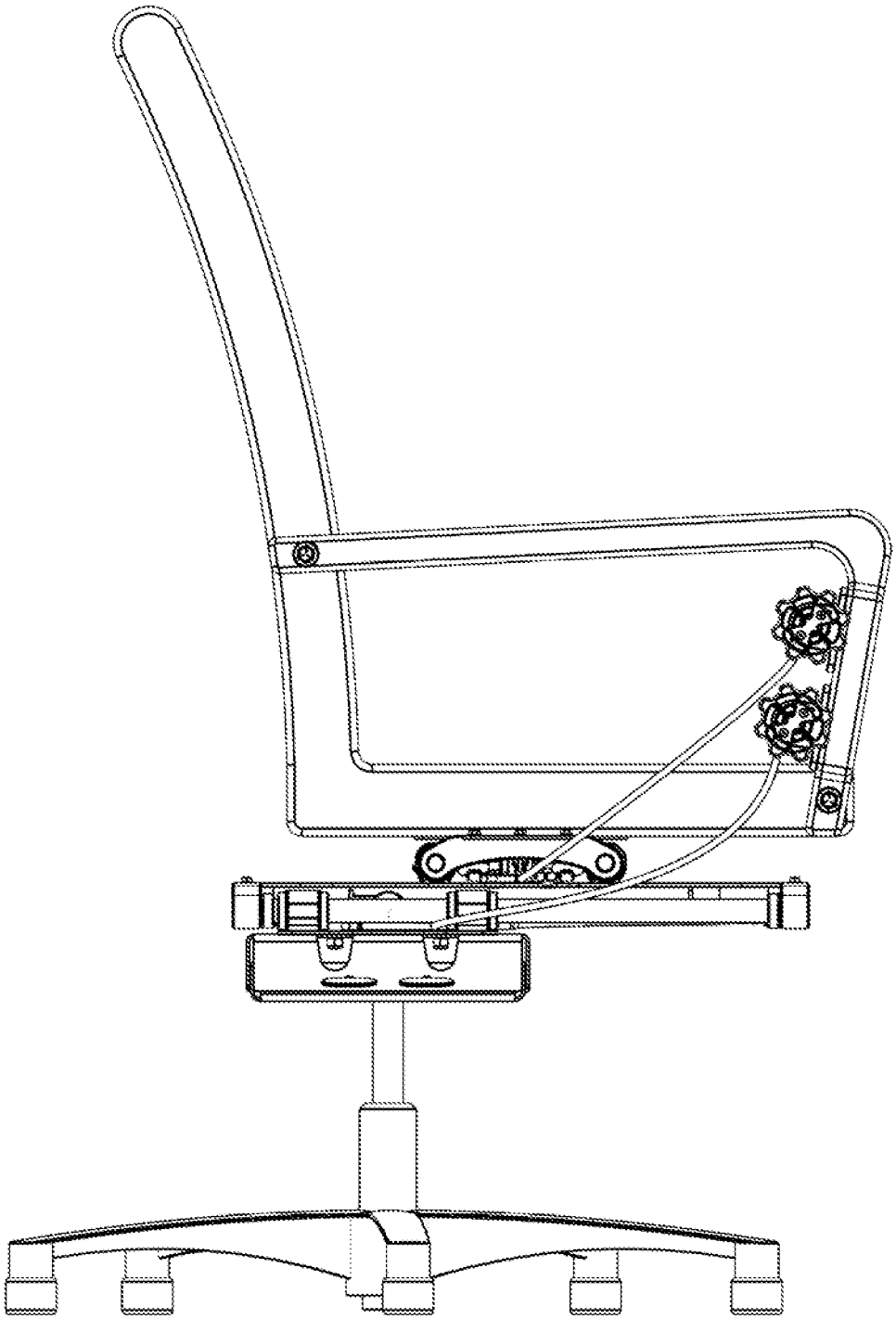
FIG. 3 is a side view of the active chair in full front displacement.
Figure 4:
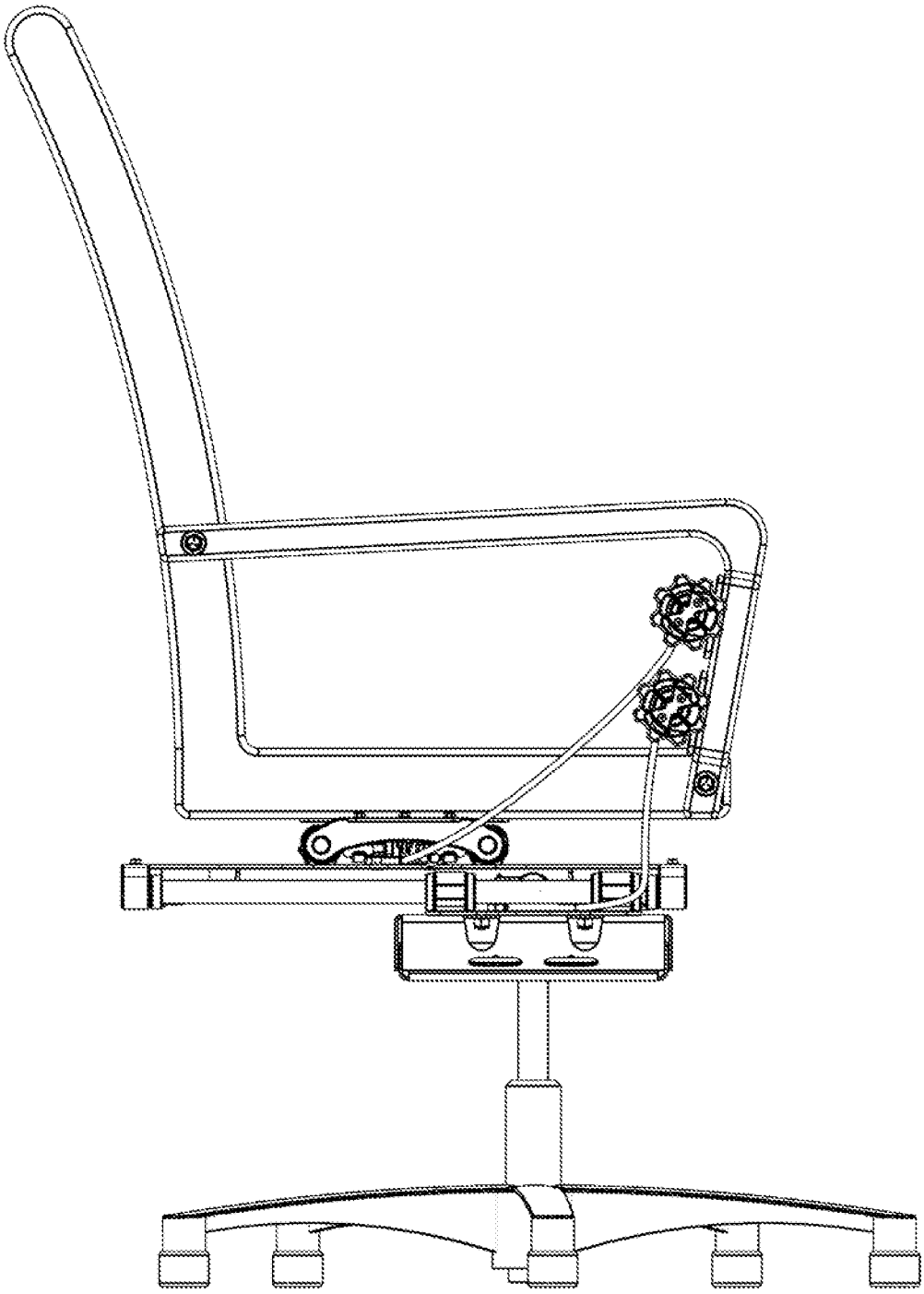
FIG. 4 is a side view of the active chair in the full back displacement.
Figure 5:
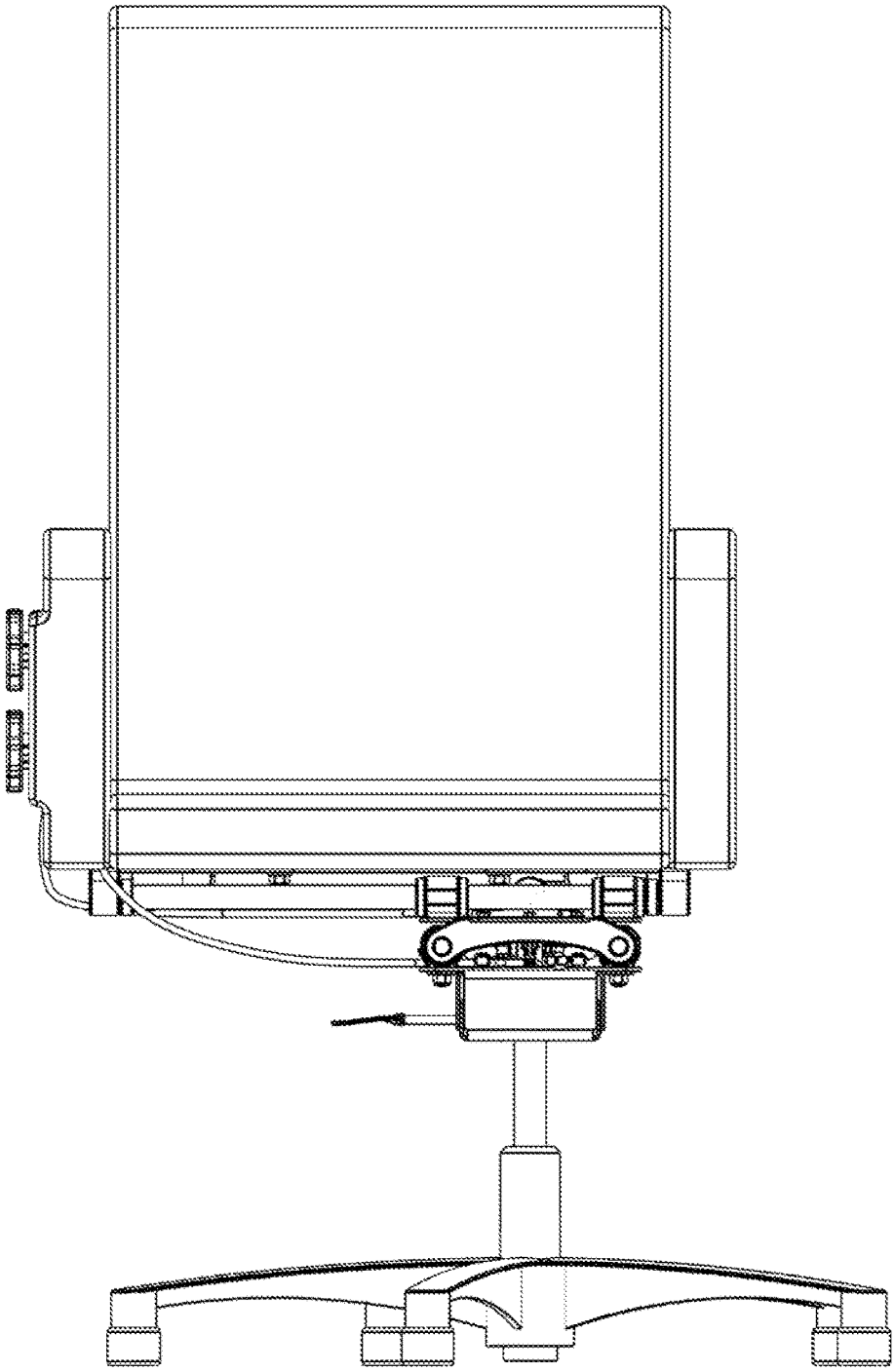
FIG. 5 is a front view of the active chair in the full right displacement.
Figure 6:
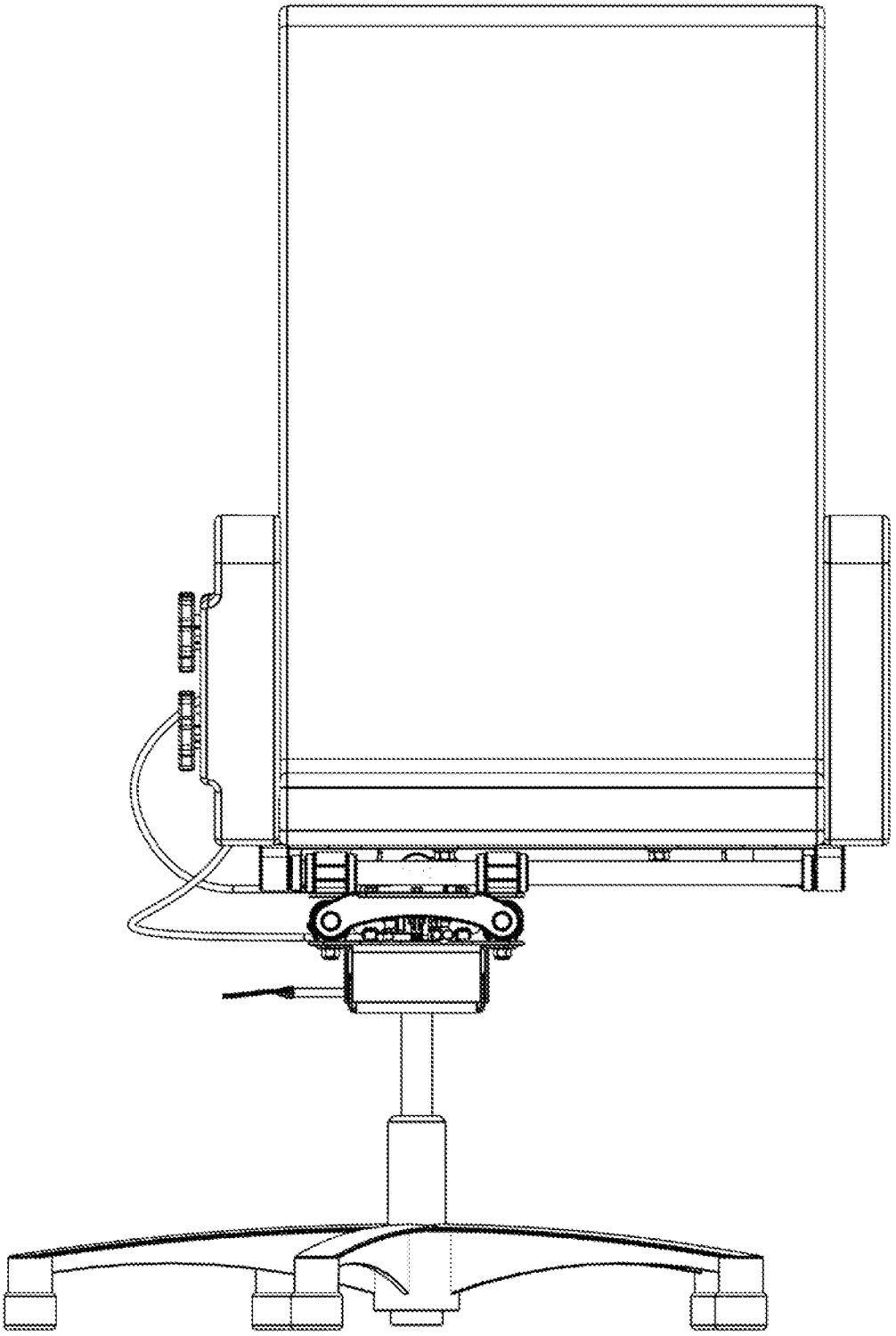
FIG. 6 is a front view of the active chair in the full left displacement.
Figure 7:
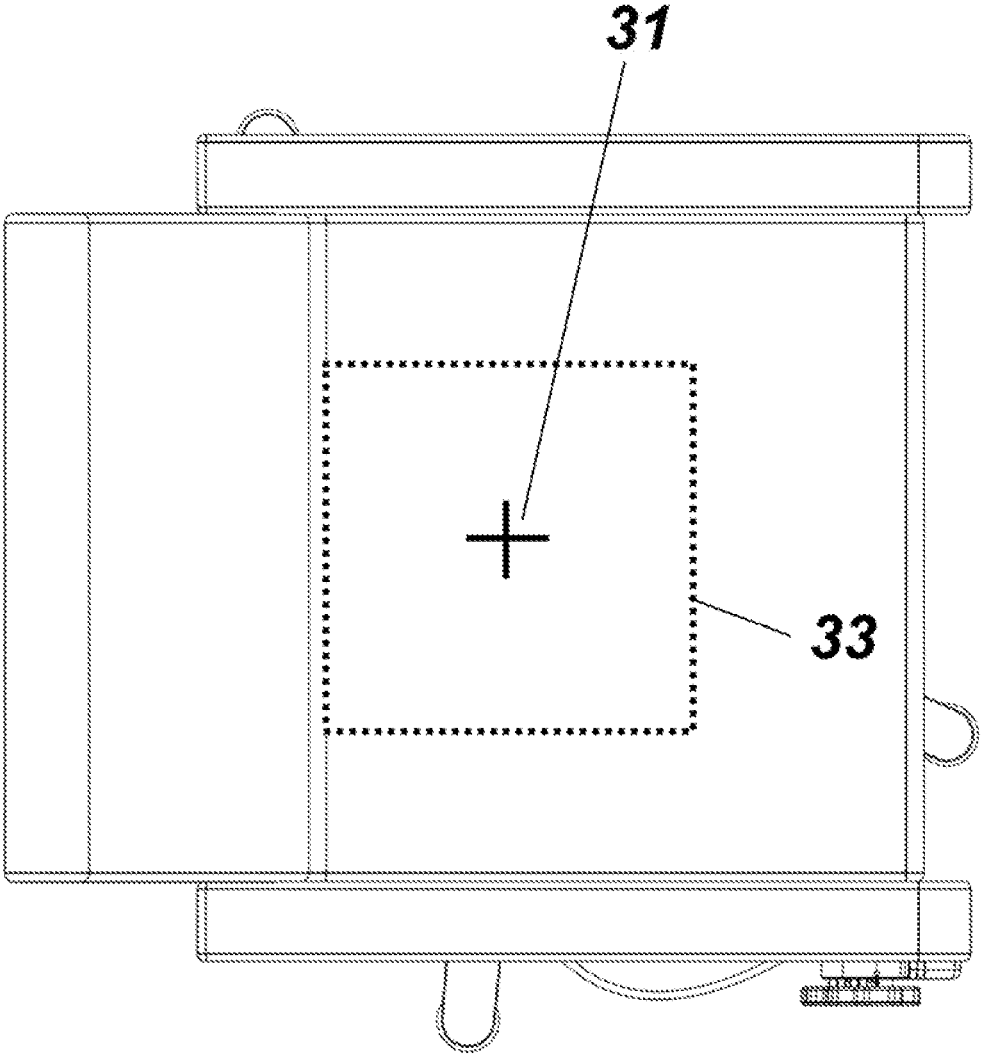
FIG. 7 is a top view of the active chair in the neutral position.
Figure 8:
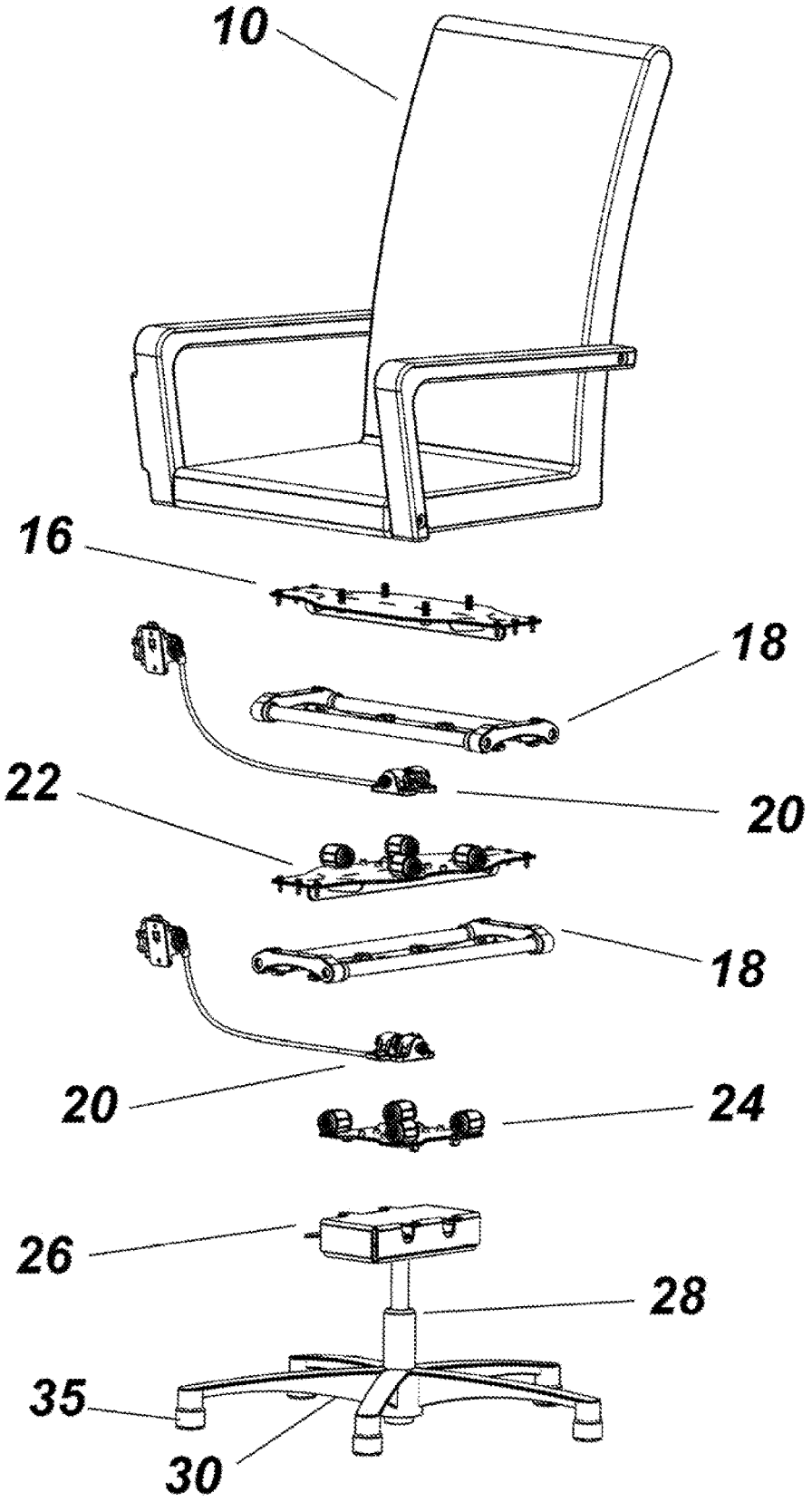
FIG. 8 is an exploded perspective view of the active chair in the neutral position.

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

An office chair assembly 10 is generally formed from a seat portion, a backrest portion extending upward from the seat portion, a base supporting the seat portion and the backrest portion, and a plurality of legs attached to said base for holding the chair assembly 10. Referring to FIGS. 1 to 8, the office chair seat assembly 10 is mounted onto the top plate assembly 16. Top plate assembly 16 is mounted onto linear shaft assembly 18. Brake system assembly 20 mounts onto middle plate assembly 22 and interacts with top plate assembly 16 providing braking or complete stop for right-to-left linear displacement. Middle plate assembly 20 is mounted onto the second linear shaft assembly 18. Second brake system assembly 20 mounts onto bottom plate assembly 24 and interacts with middle plate assembly 22 providing braking or complete stop for front-to-back linear displacement. The bottom plate 24 mounts onto standard office chair tilter assembly 26 that fits on top of standard office chair gas cylinder 28 which is then mounted on a standard office chair base 30. The chair tilter assembly 26, the gas cylinder 28, and the office chair base 30 with chair base glides 35 allow for standard up and down height adjustment, seat rotation, and forward and backward seat tilt that can be locked at any angle within the tilting angle range. The chair seat assembly 10 is capable of front-to-back (Figure m and right-to-left (FIGS. 5 and 6) linear displacements. Each displacement direction can be locked at any point using one of the two brake system assemblies 20. Displacement can be performed individually or in combination where the center of the chair 31 can move anywhere within the movement boundary 33. The movement boundary 33 is fixed with respect to the bottom plate assembly 24, office chair tilter assembly 26, gas cylinder 28, and the chair base 30 whereas the center of the chair 31 is free to move with respect to the bottom plate assembly 24, office chair tilter assembly 26, gas cylinder 28, and the chair base 30.

Figure 9:
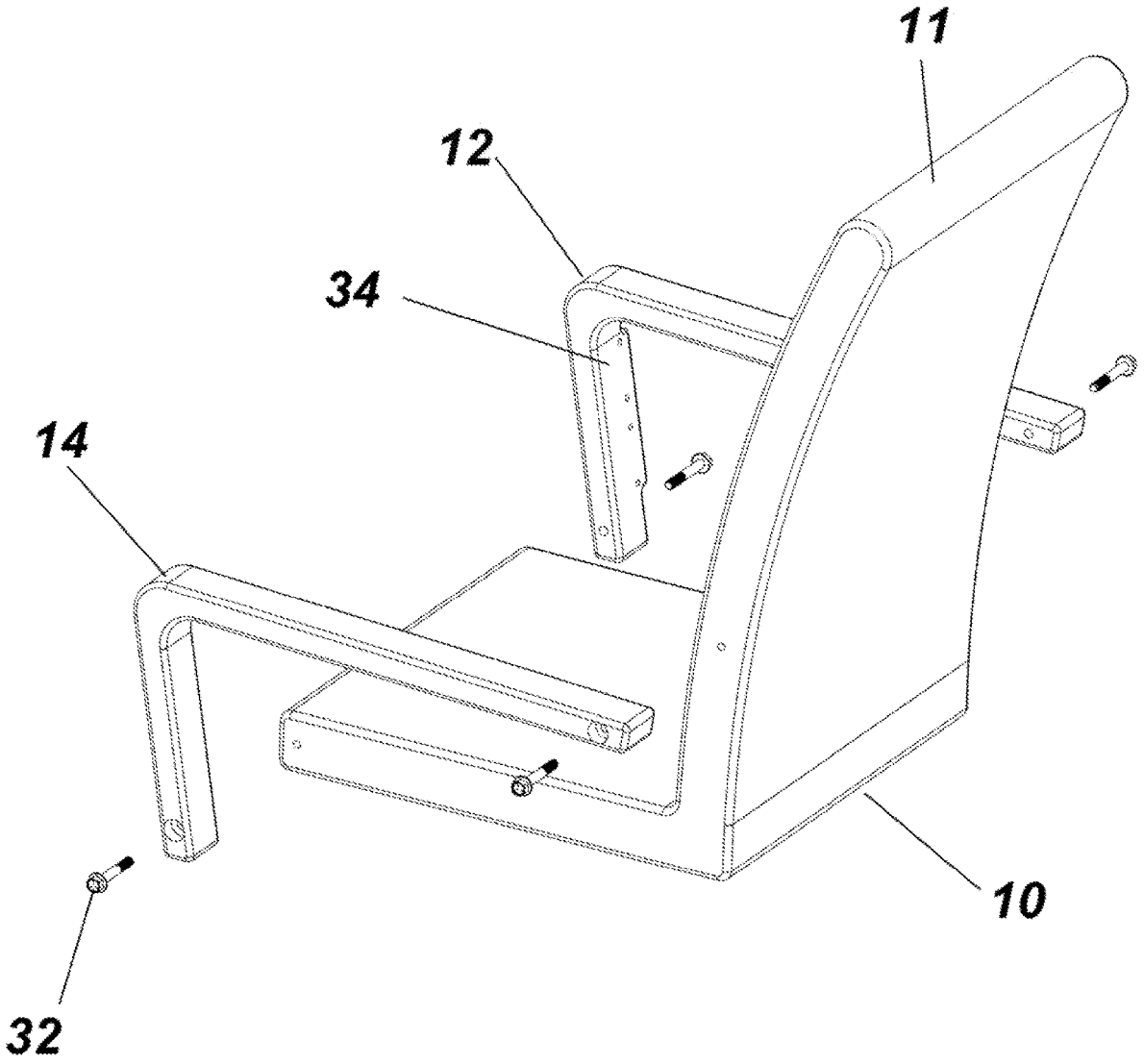
FIG. 9 is an exploded rear perspective view of the office chair seat assembly.
Figure 10:
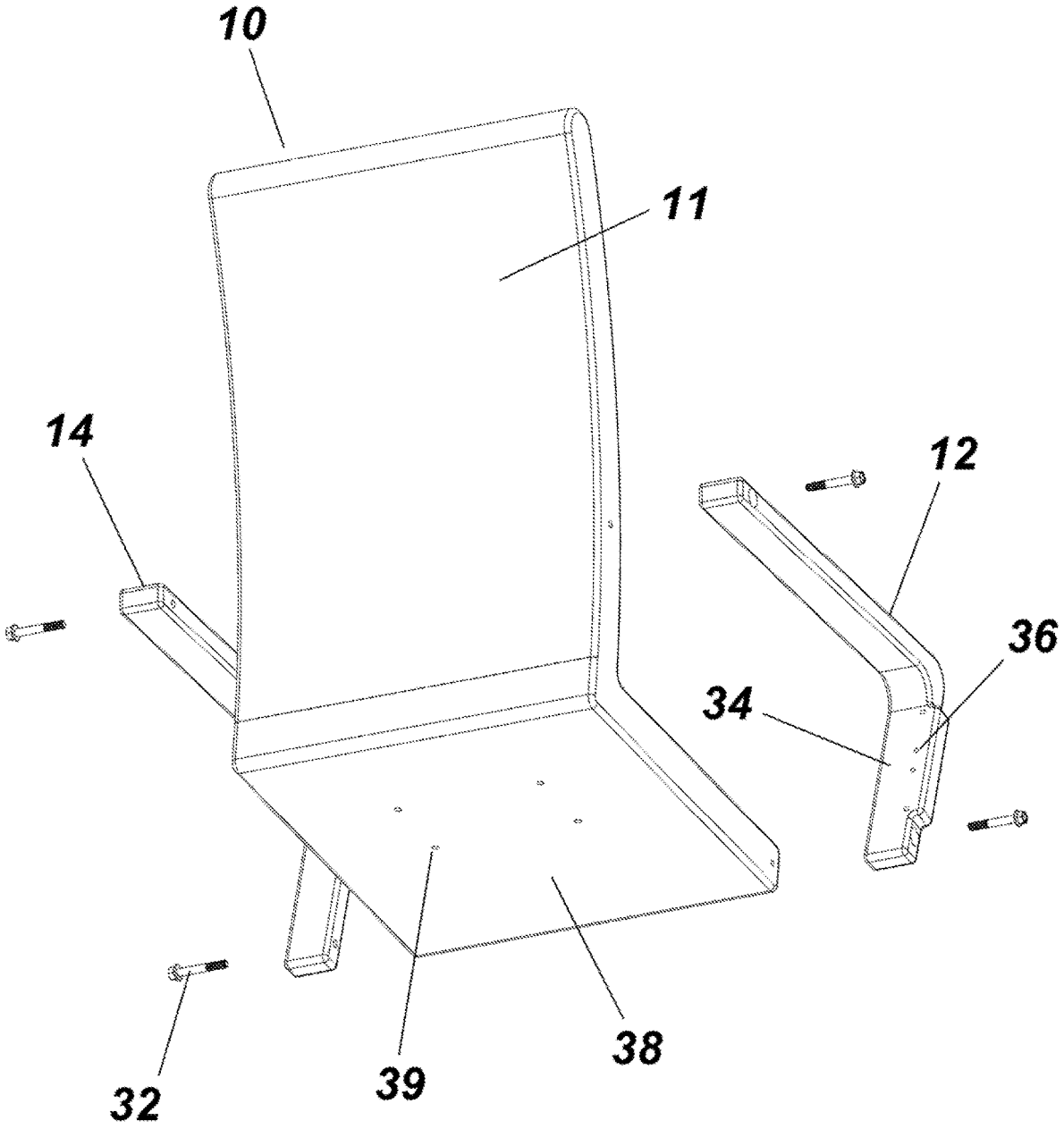
FIG. 10 is an exploded bottom perspective view of the office chair seat assembly.
Figure 11:
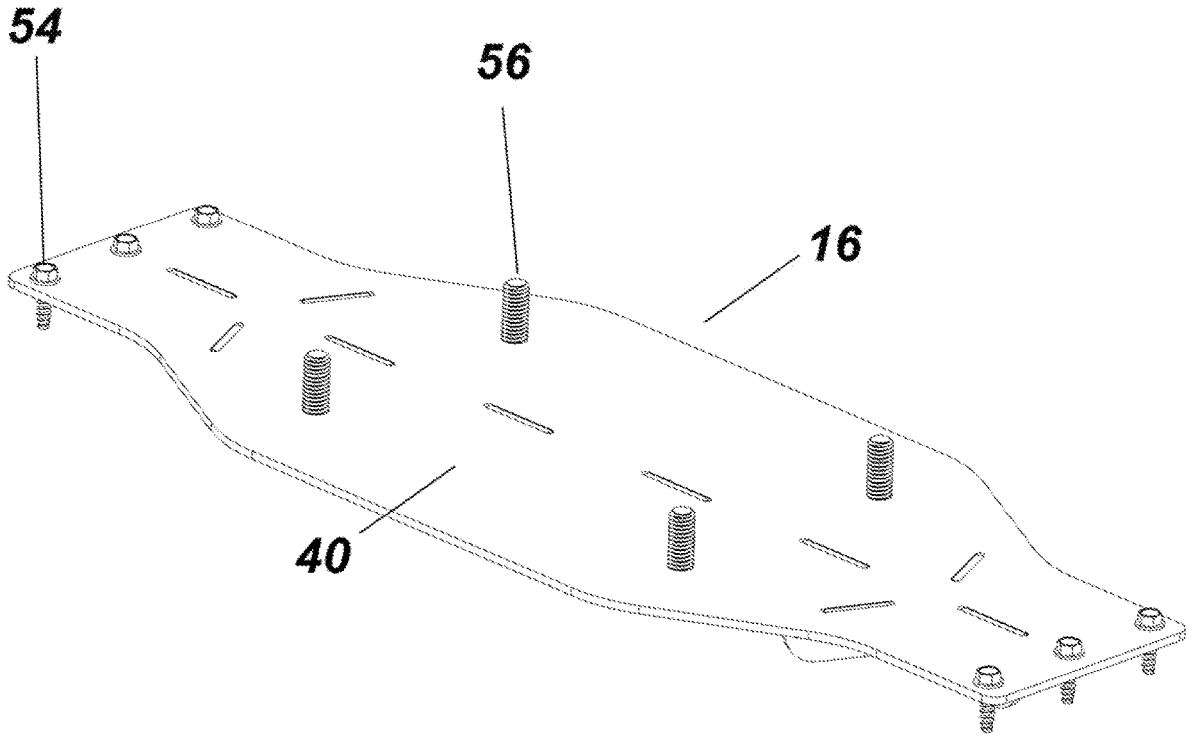
FIG. 11 is a top perspective view of the top plate assembly.
Figure 12:
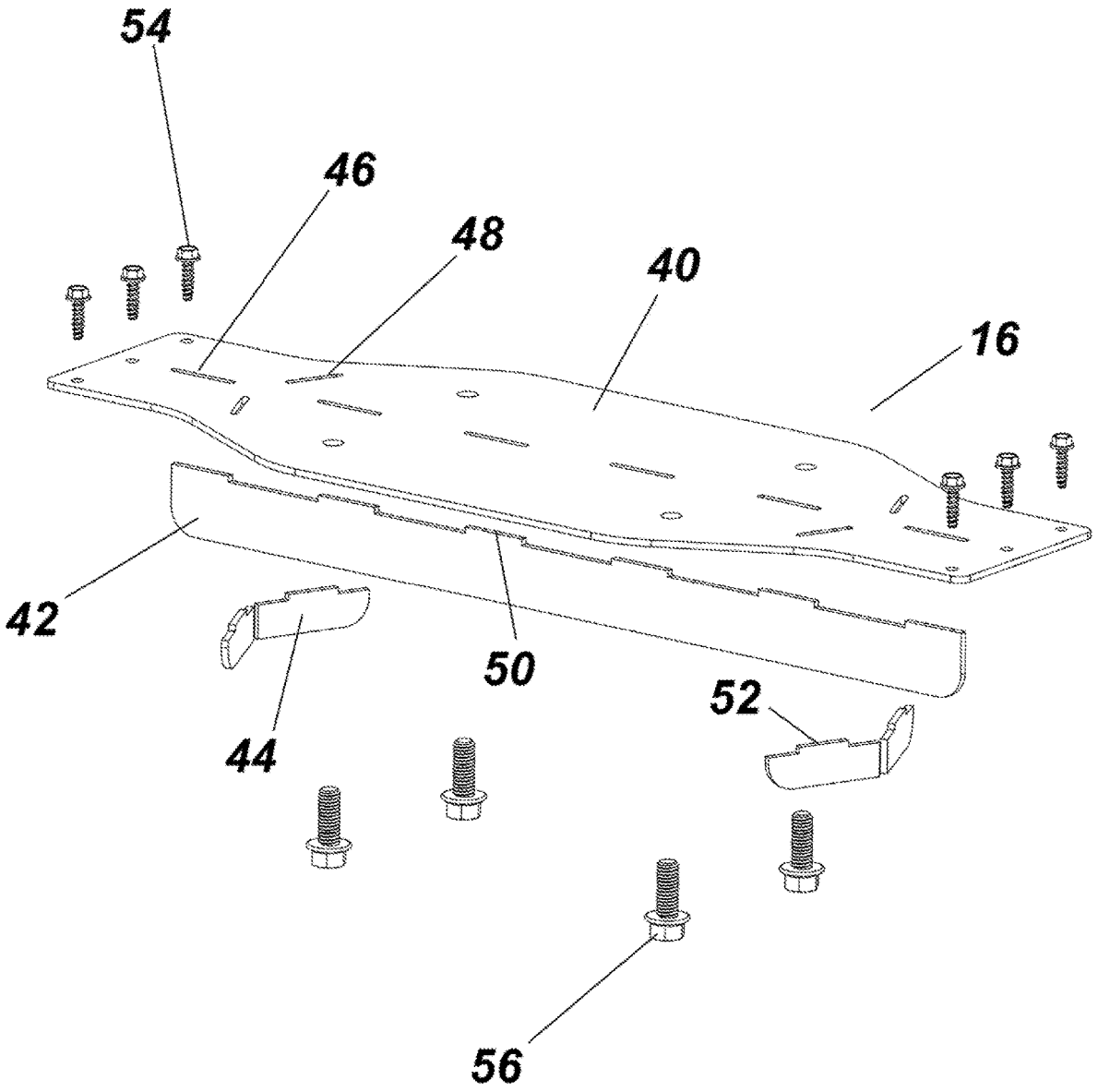
FIG. 12 is an exploded top perspective view of the top plate assembly.
Figure 13:
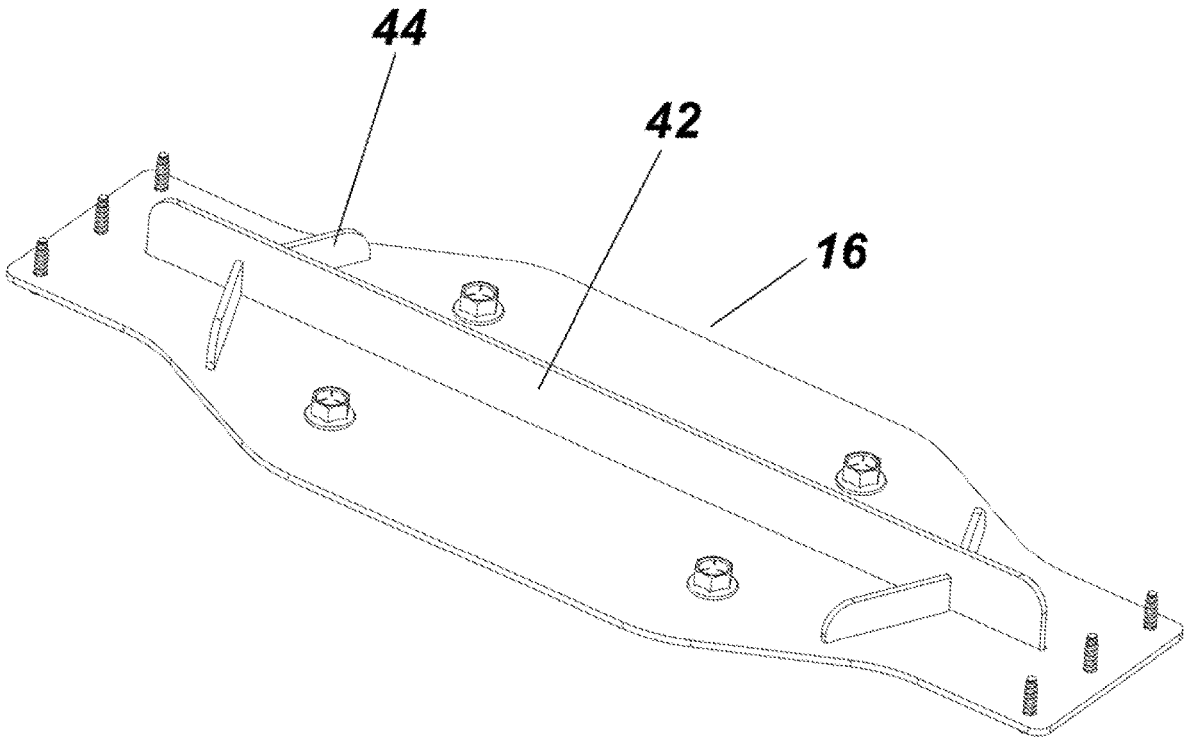
FIG. 13 is a bottom perspective view of the top plate assembly.
Figure 14:
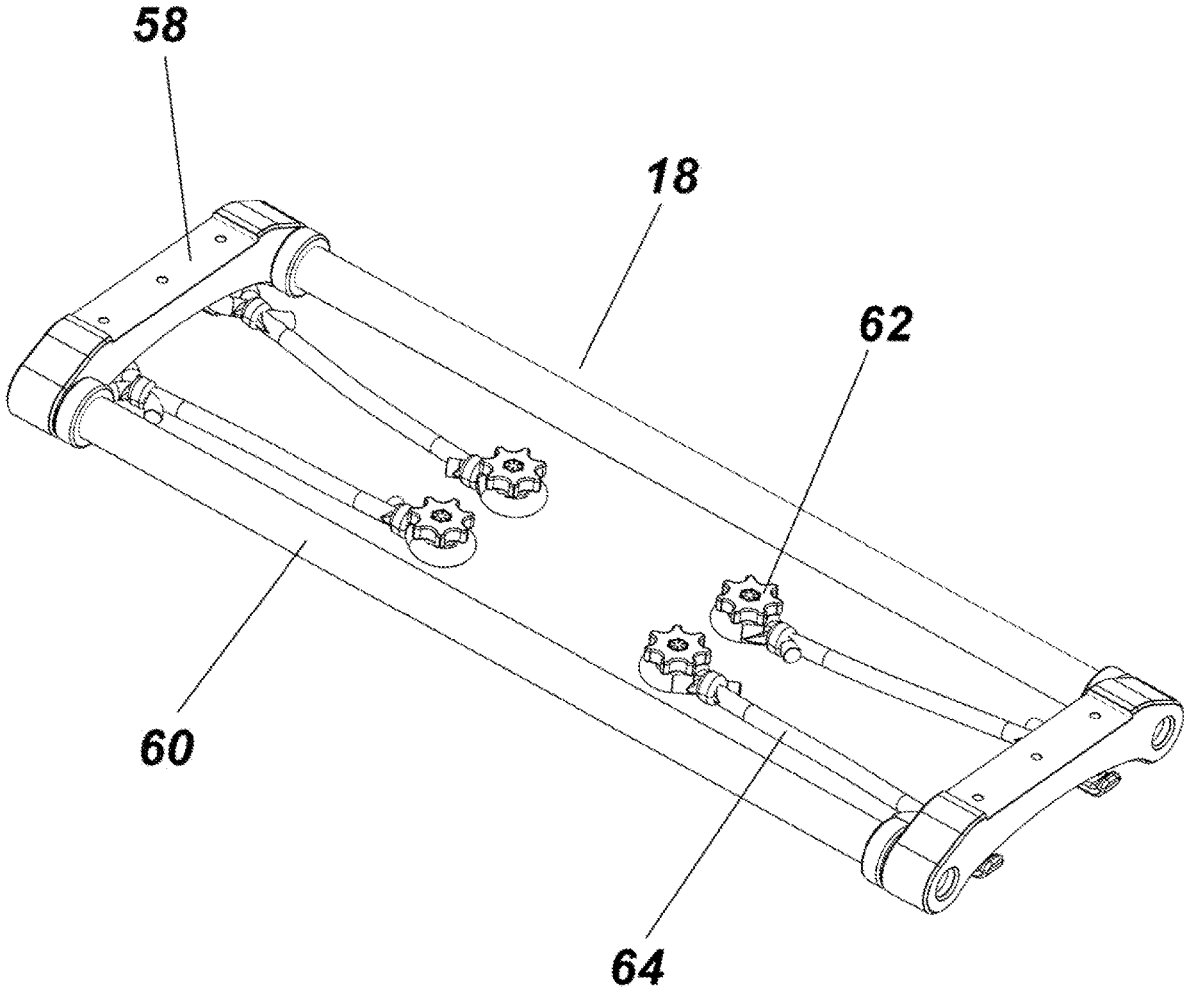
FIG. 14 is a top perspective view of the linear shaft assembly.
Figure 15:
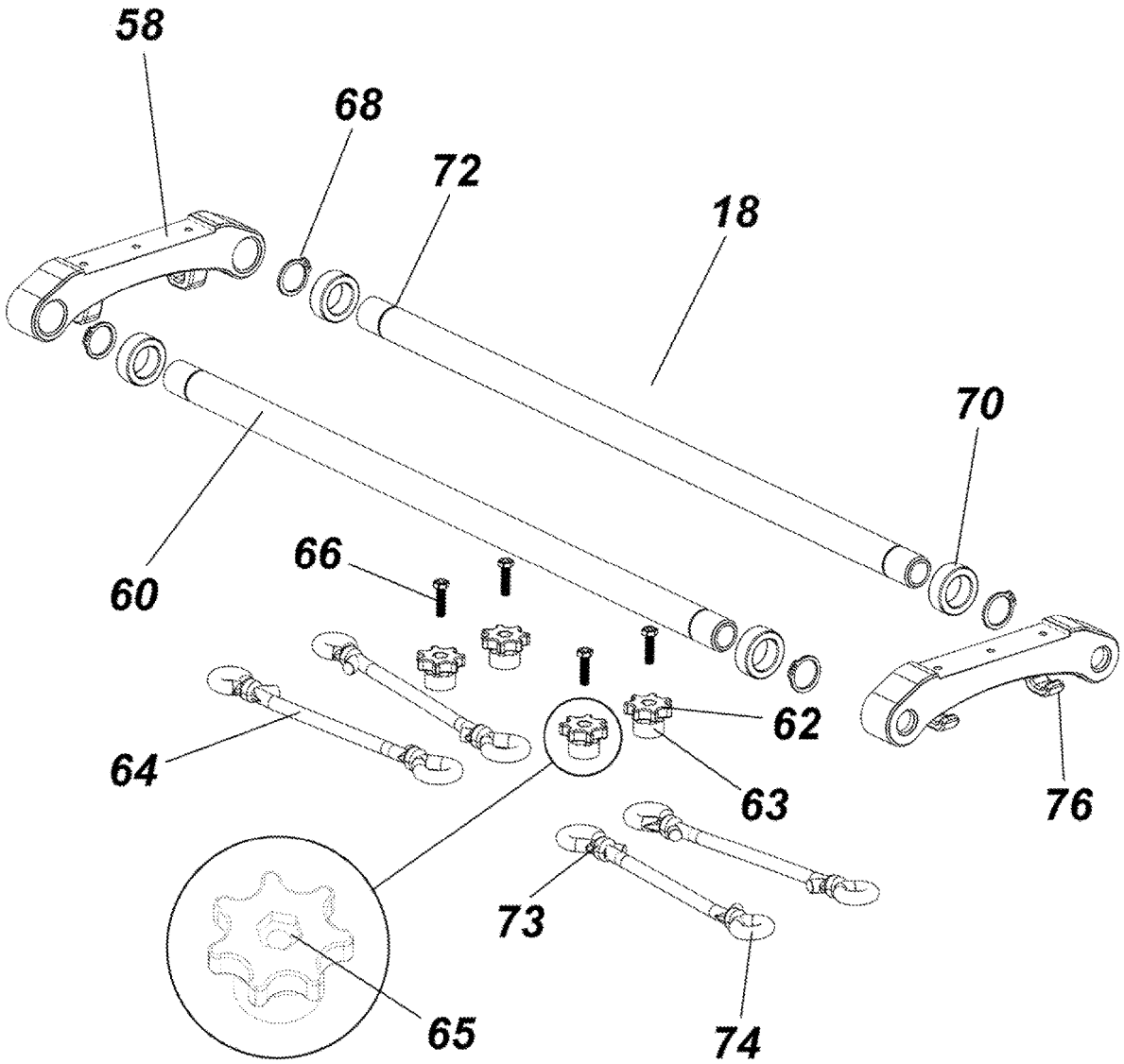
FIG. 15 is an exploded top perspective view of the linear shaft assembly.
Figure 16:
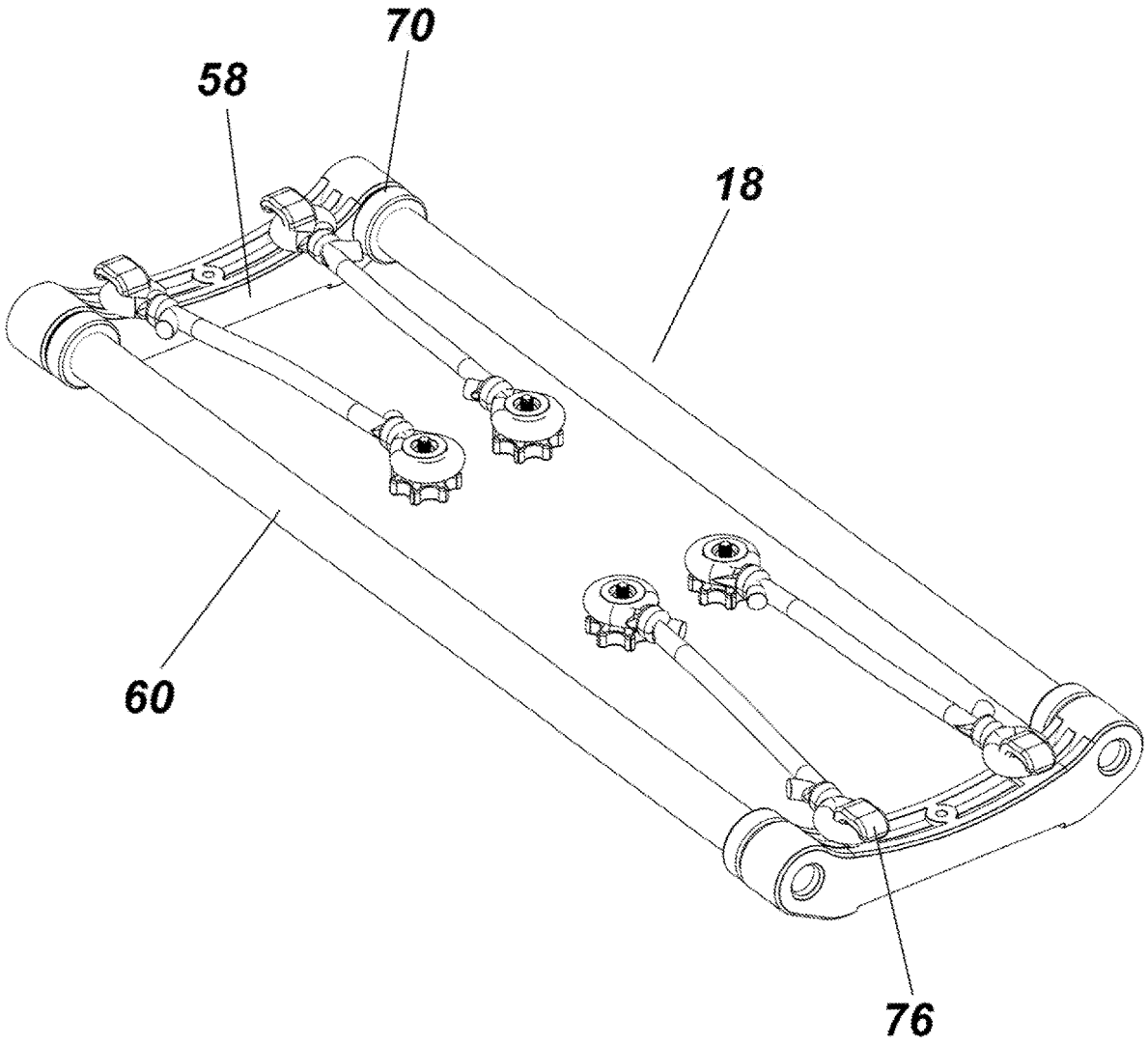
FIG. 16 is a bottom perspective view of the linear shaft assembly.

Referring to FIGS. 9 to 10, the armrests 12 and 14 are mounted to the office chair seat shell 11 using four screws 32. Armrest 12 provides expanded mounting surface 34 with four mounting holes 36. The bottom surface 38 of the office chair seat shell 11 has four mounting holes 39.

Referring to FIGS. 1 to 14, the top plate assembly 16 consists of top plate 40, transverse beam 42, and four angled beams 44. Beam 42 interlocks with the top plate 40 by the use of six locating cut-outs 46 in the top plate 40 and six extrusions 50 on the beam 42. Four angled beams 44 interlock with the top plate 40 by the use of one locating cut-out 48 per angled beam 44 in the top plate 40 and one locating extrusion 52 per angled beam 44. Beams 42 and 44 are welded to top plate 40 and increase structural stability of the top plate 40. Six screws 54 are used to attach top plate assembly 16 to two linear shaft assembly 18 linear shaft connectors 58. Four screws 56 are used to attach the bottom surface 38 of office chair seat assembly 10 to the top plate 40 of the top plate assembly 16.

Figure 17:
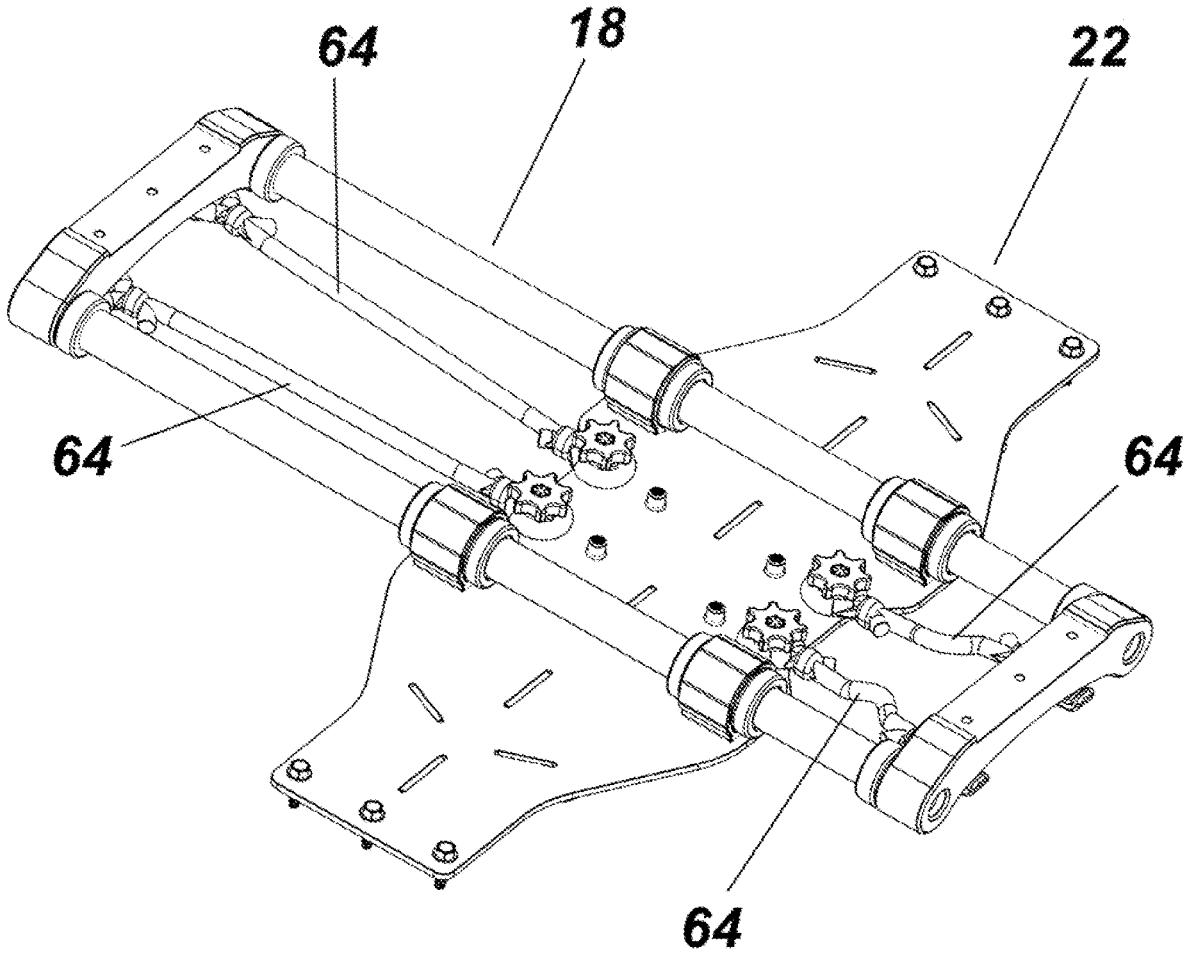
FIG. 17 is a top perspective view of displaced linear shaft assembly with respect to the middle plate assembly.

Referring to FIGS. 14 to 20, two linear shaft connectors 58 house two linear shafts 60. The two linear shafts 60 slide through four linear bearings 82. The two linear shaft connectors 58 keep the two linear shafts 60 in alignment and provide attachment for the top plate assembly 16. Two external retaining rings 68 per linear shaft 60 are snapped onto the retaining ring groove 72. Two viscoelastic washers 70 per linear shaft 60 are placed proximally to each retaining ring 68. The retaining rings 68 along with the washers 70 provide a cushioning stop when the chair mechanism reaches full displacement in either direction as depicted in FIGS. 3 through 6. Four knobs 62 are attached to the middle plate assembly 22 via four screws 66 and four rivet nuts 86. Four stretchable elastic elements 64 with looped ends 74 created by the use of deformable metal sleeves 73 attach to four hooks 76 of the linear shafts connectors 58 and to the cylindrical portion 63 of the four knobs 62. The four elastic elements 64 are mounted in a pretensioned state. The linear shaft assembly 18 is free to move with respect to the middle plate assembly 22 facilitating right-to-left displacement. The four elastic elements 64 keep the linear shaft assembly 18 centered with respect to the middle plate assembly 22. In case of displacement as shown in FIG. 17, two of the four elements 64 are stretched while the opposing two are relaxed thus providing the desirable resistance to movement.

Figure 18:
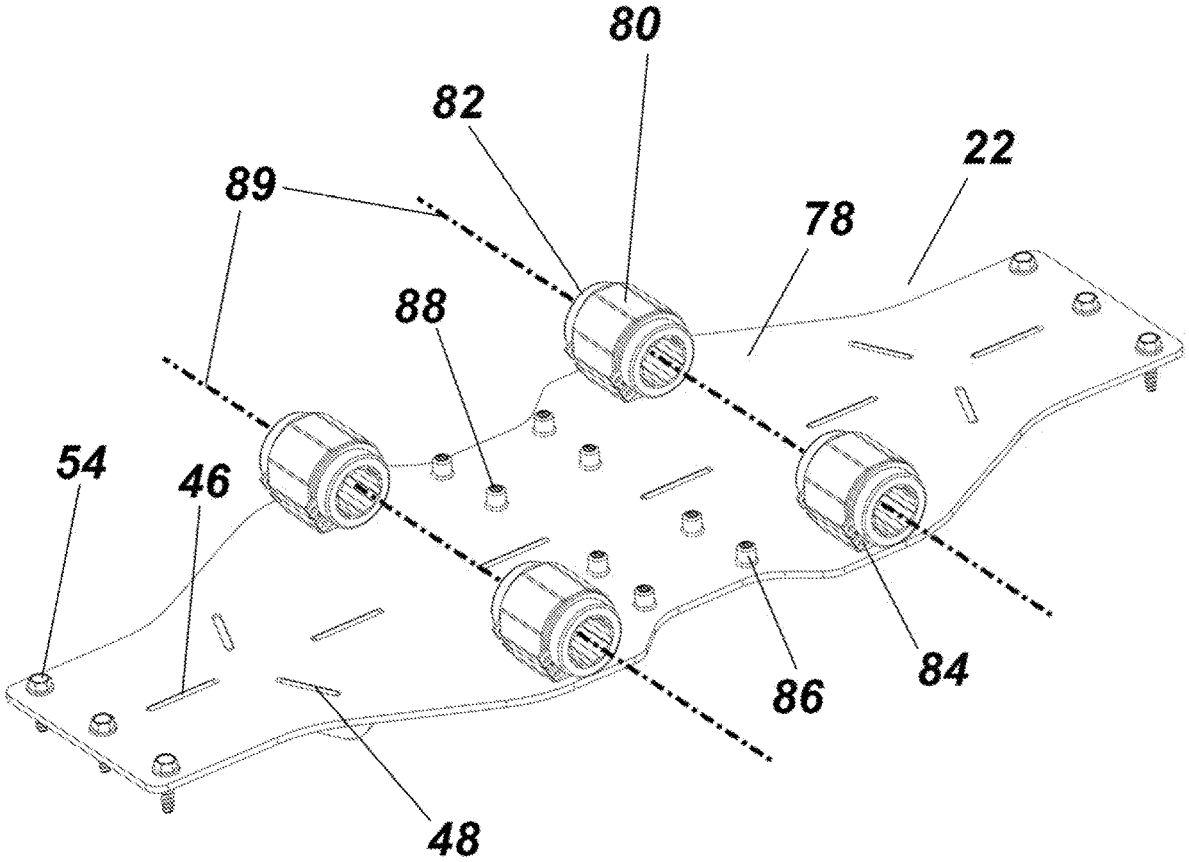
FIG. 18 is a top perspective view of the middle plate assembly.
Figure 19:
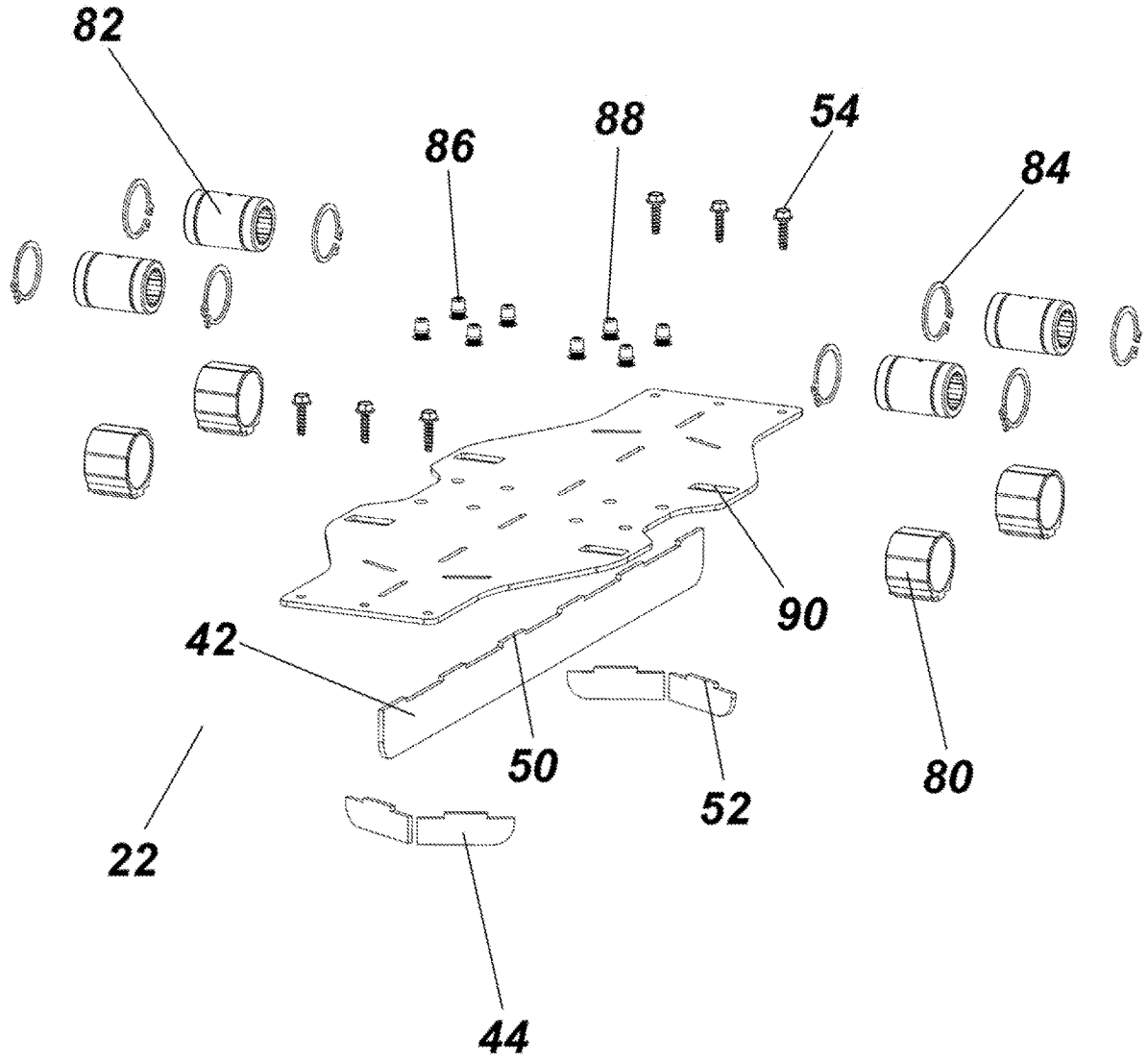
FIG. 19 is an exploded top perspective view of the middle plate assembly.
Figure 20:
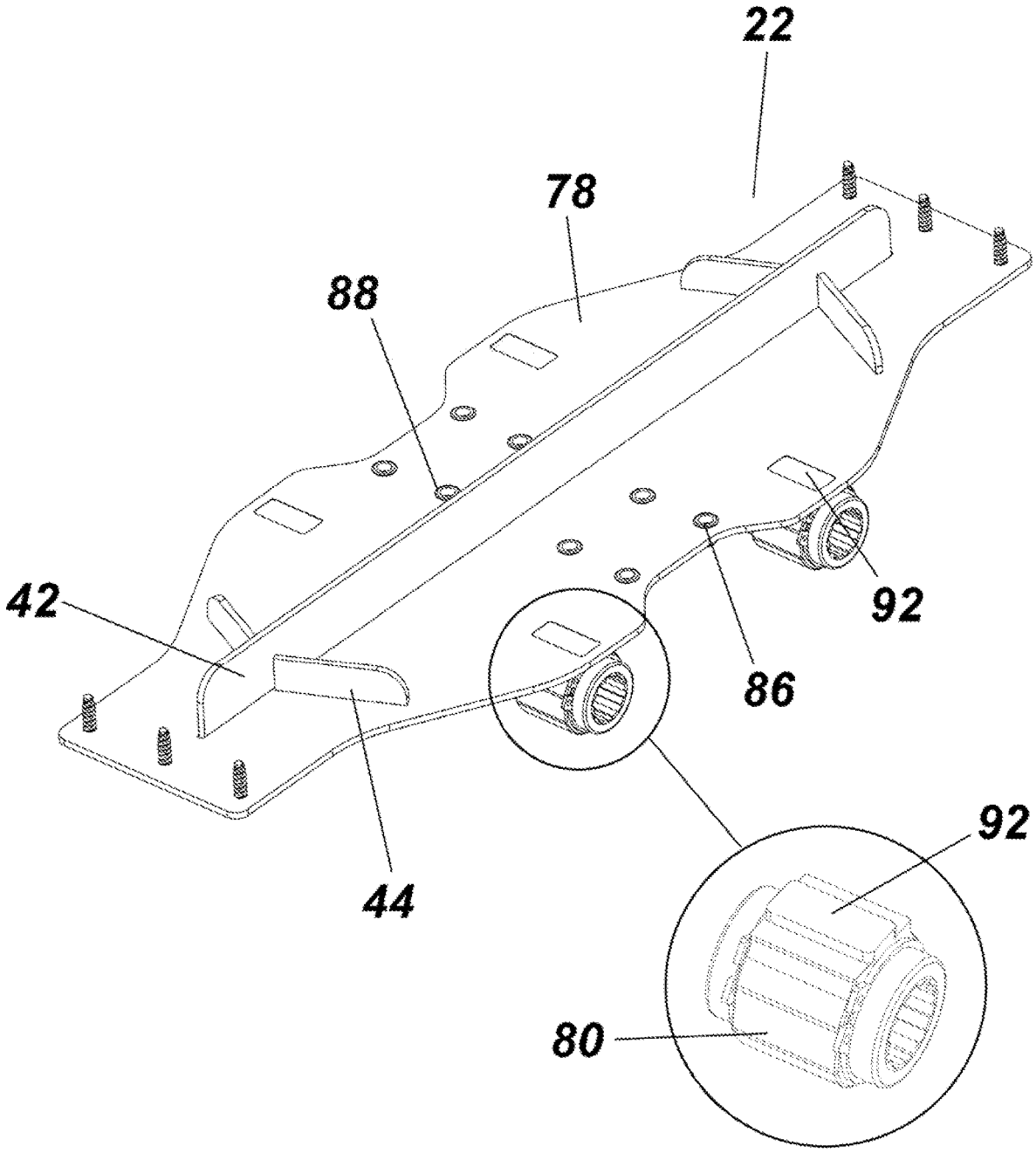
FIG. 20 is a bottom perspective view of the middle plate assembly.

Referring to FIGS. 18 to 20, the middle plate assembly 22 consists of a middle plate 78, four linear bearing housings 80, transverse beam 42, and four angled beams 44. Beam 42 interlocks with the middle plate 78 by the use of six locating cut-outs 46 in the middle plate 78 and six extrusions 50 in the beam 42. Four angled beams 44 interlock with the middle plate 78 by the use of one locating cut-out 48 per angled beam 44 in the top plate 40 and one locating extrusion 52 per angled beam 44. Beams 42 and 44 are welded to middle plate 78 and increase structural stability of the middle plate 78. The four bearing housings 80 are aligned with the middle plate 22 by the use of four rectangular cutouts 90. The rectangular extrusion 92 on each bearing housing 80 fit tightly in the rectangular cutouts 90 and assist in maintaining collinearity and parallelism of the linear bearing's 82 longitudinal axes 89. Bearing housings 80 are welded to the middle plate 78. Four linear bearings 82 are inserted into four bearing housings 80 and held in place using two retaining rings 84 per each bearing 82. Six screws 54 are used to attach middle plate assembly 22 to two linear shaft assembly 18 linear shaft connectors 58. It should be noted that there are two linear shaft assemblies 18, one allowing for linear right-to-left and one for front-to-back displacement.

Referring to FIGS. 15, and 18 to 20, four screws 66 and four rivet nuts 86 are used to attach four knobs 62 to the middle plate 78. The knob 62 has a hexagonal cutout 65 that fits the hexagonal head of the screw 66 thus eliminating the need for extra tools during installation and facilitating an easy exchange of elastic elements of varying stiffnesses.

Figure 21:
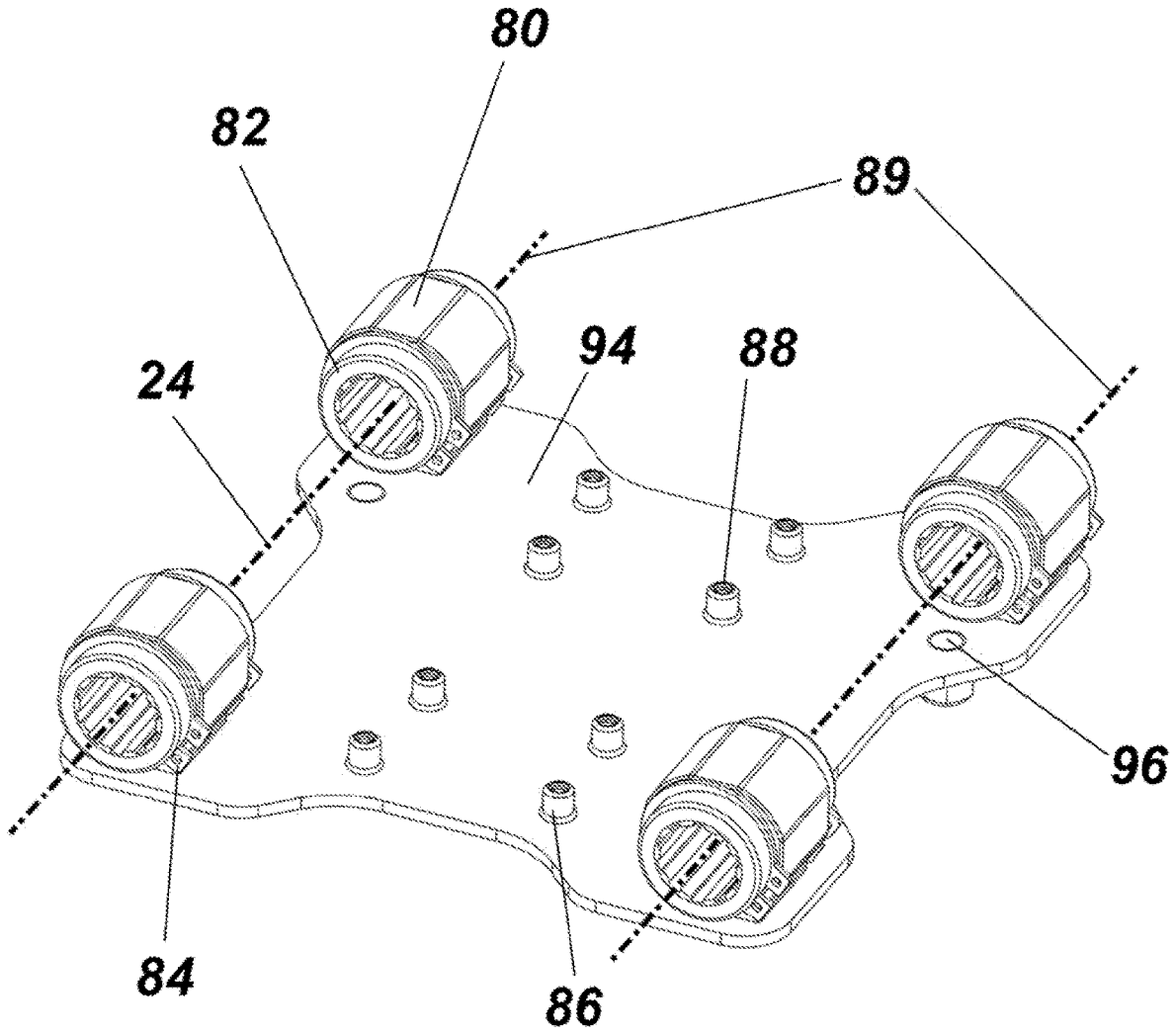
FIG. 21 is a top perspective view of the bottom plate assembly.
Figure 22:
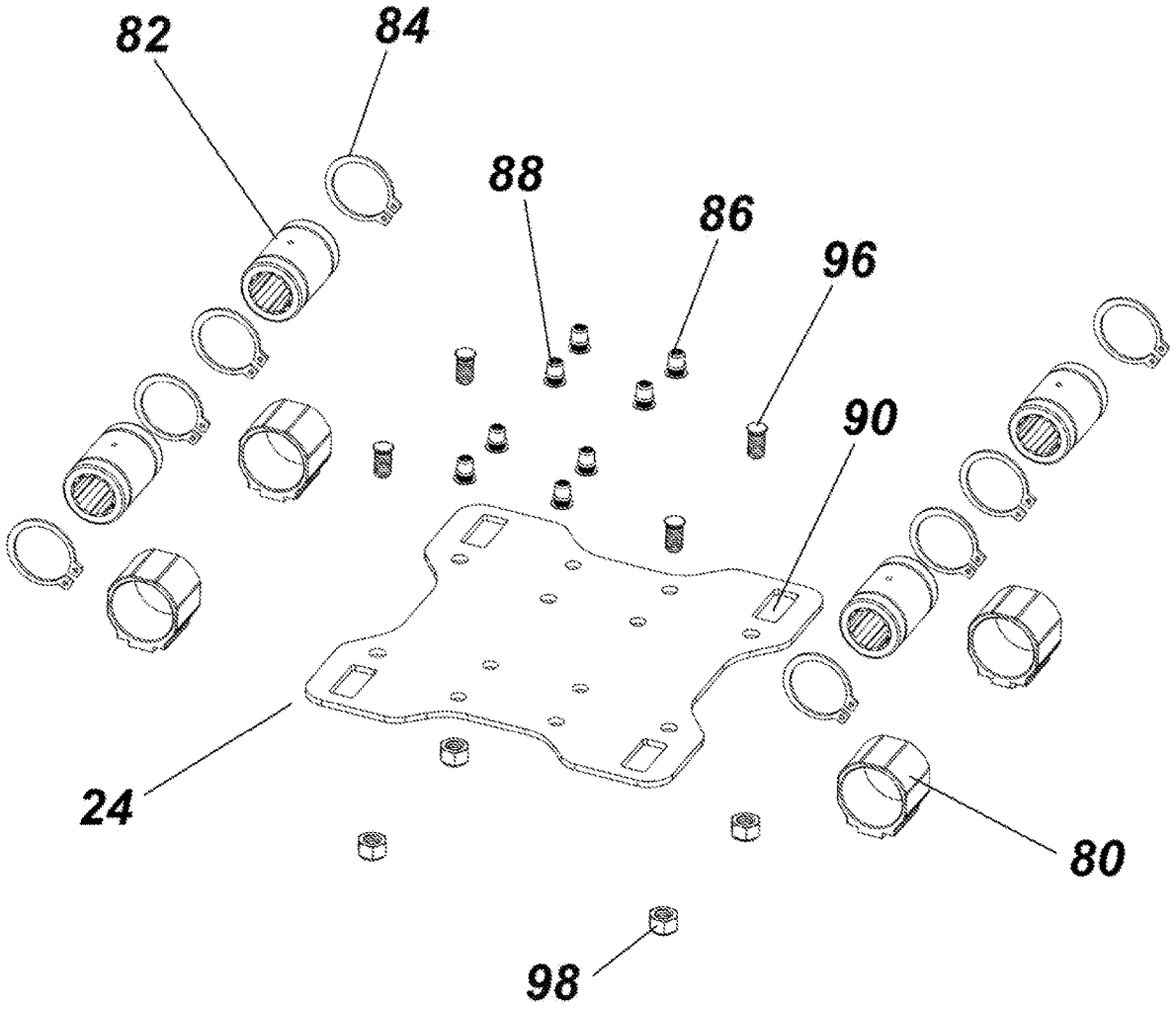
FIG. 22 is an exploded top perspective view of the bottom plate assembly.
Figure 23:
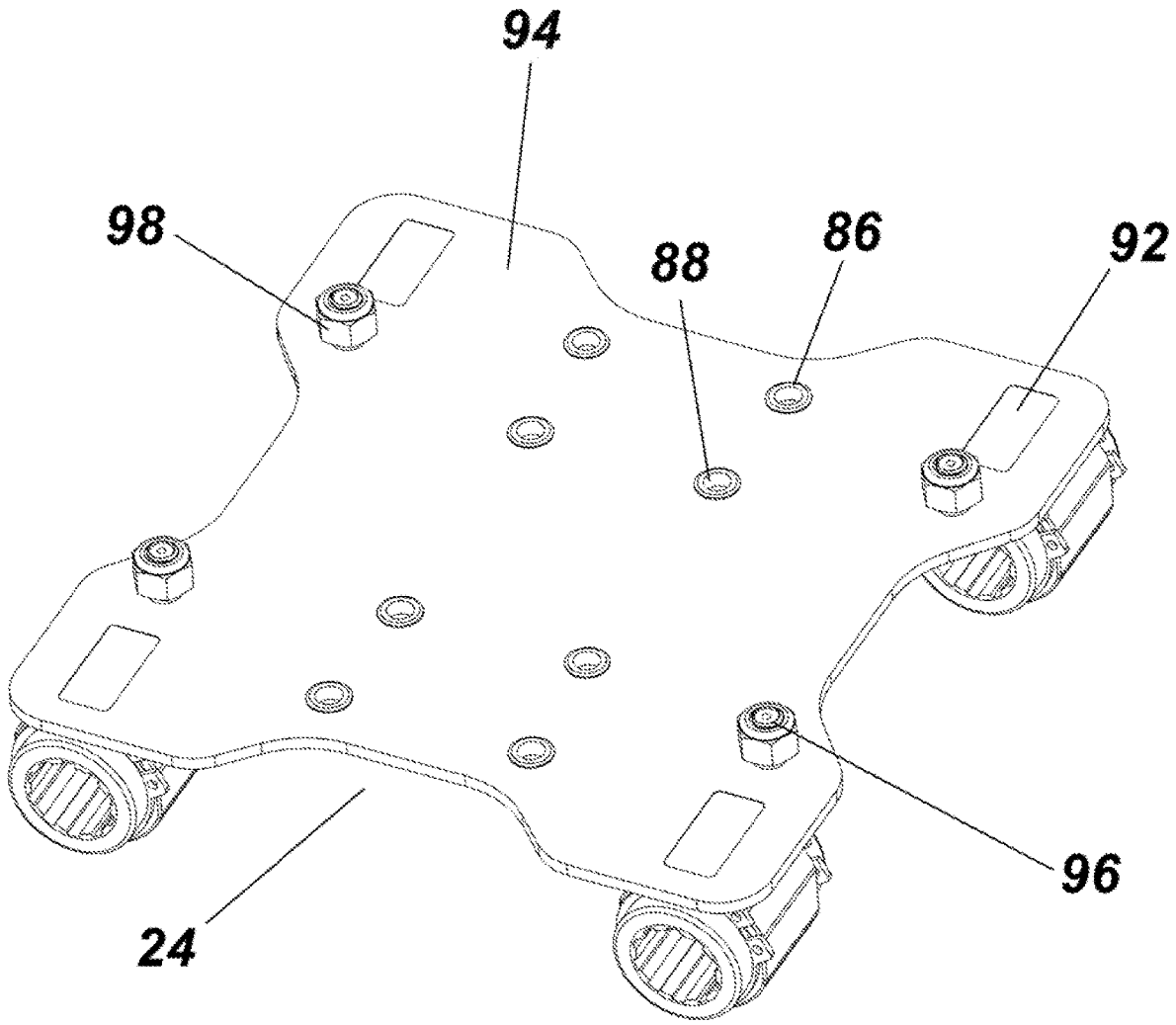
FIG. 23 is a bottom perspective view of the bottom plate assembly.
Figure 24:
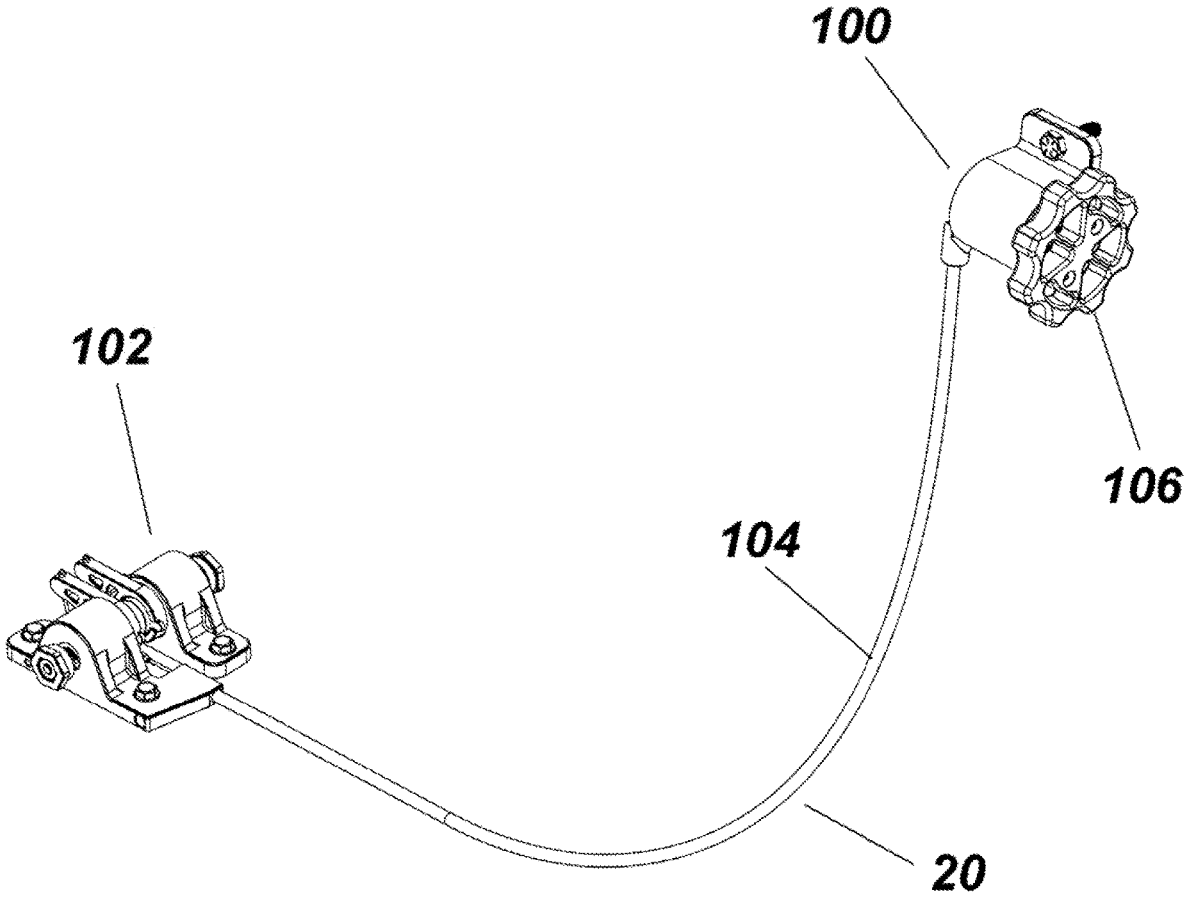
FIG. 24 is a top perspective view of the brake system assembly.
Figure 25:
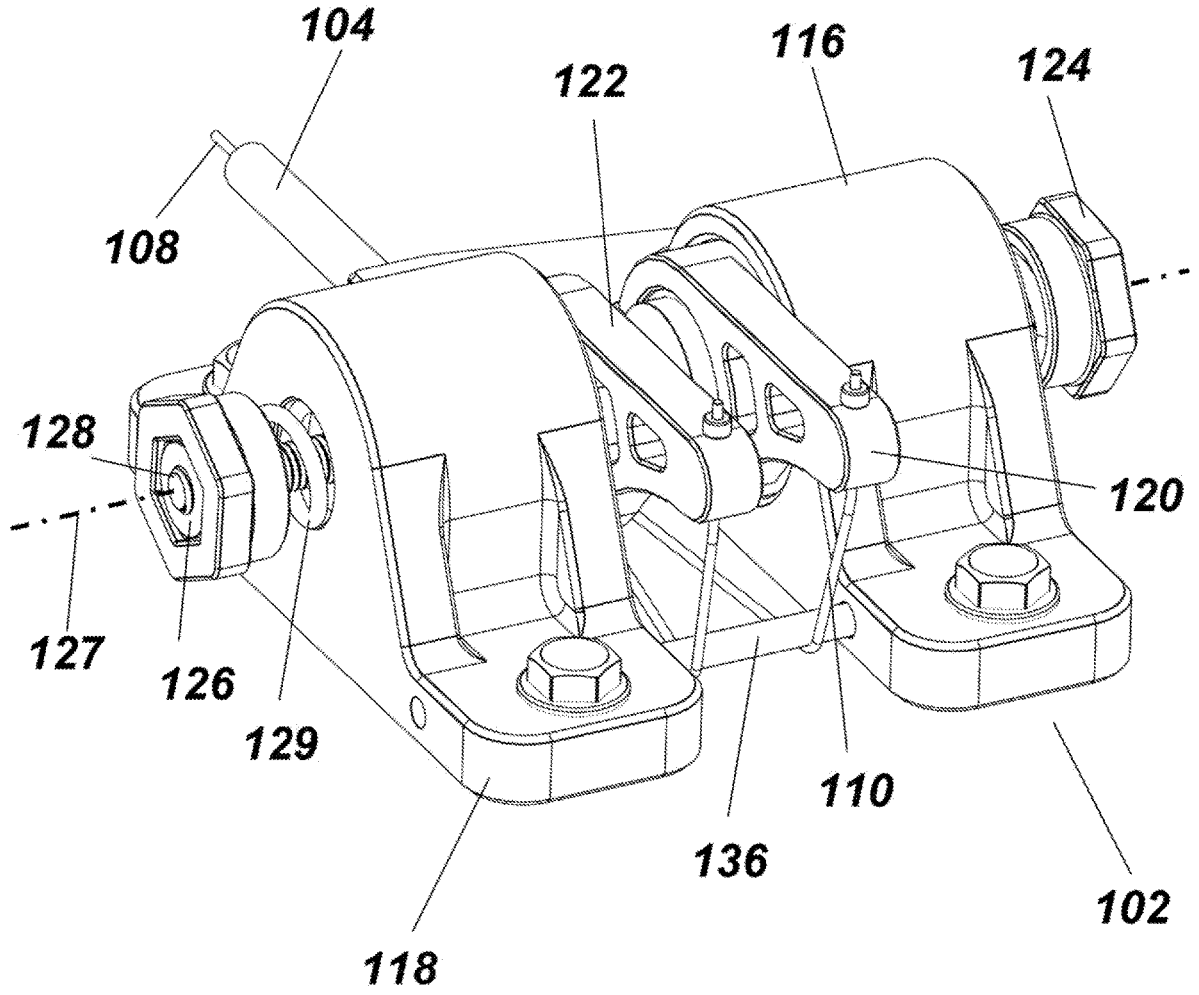
FIG. 25 is a top front perspective view of the brake caliper.
Figure 26:
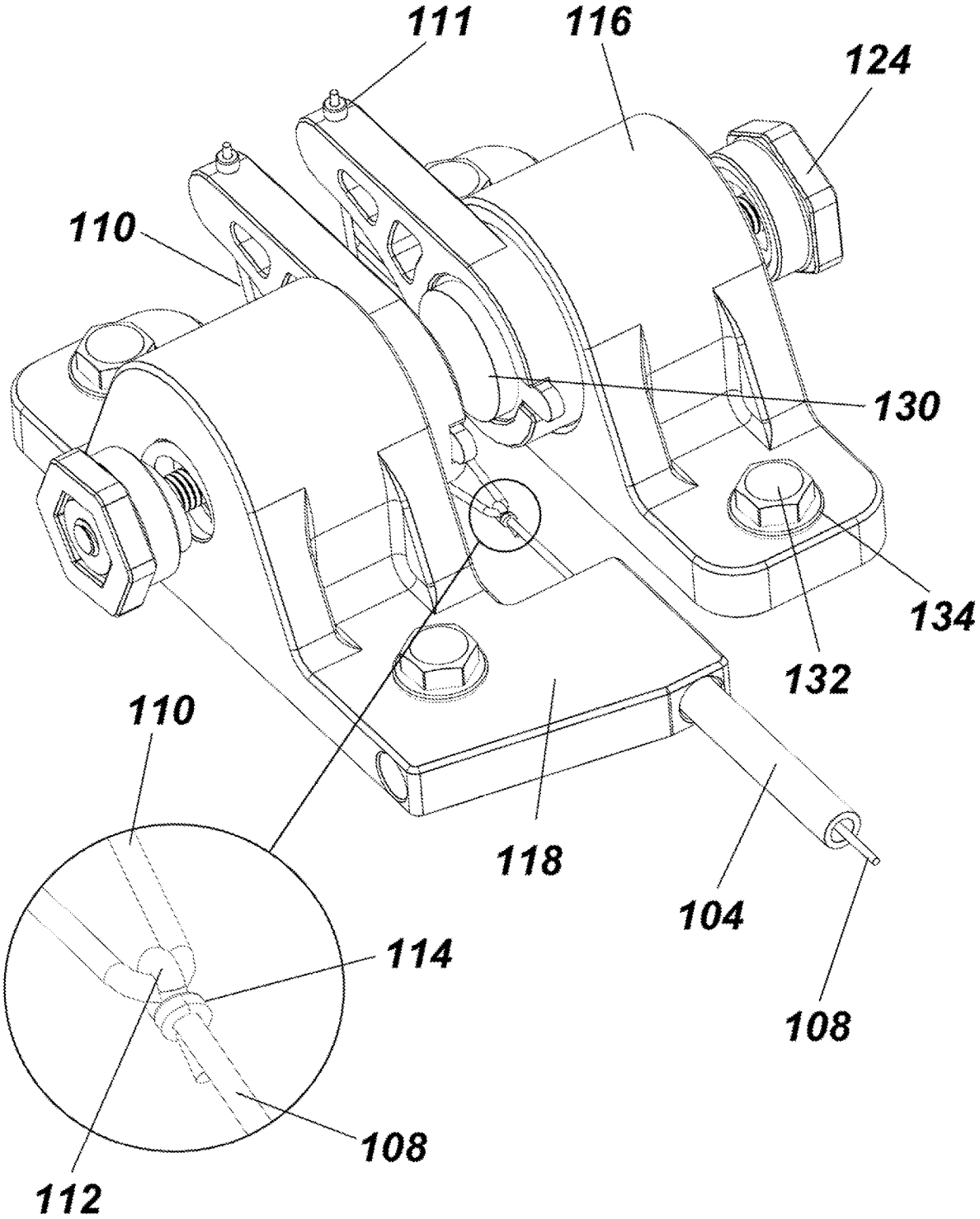
FIG. 26 is a top back perspective view of the brake caliper.
Figure 27:
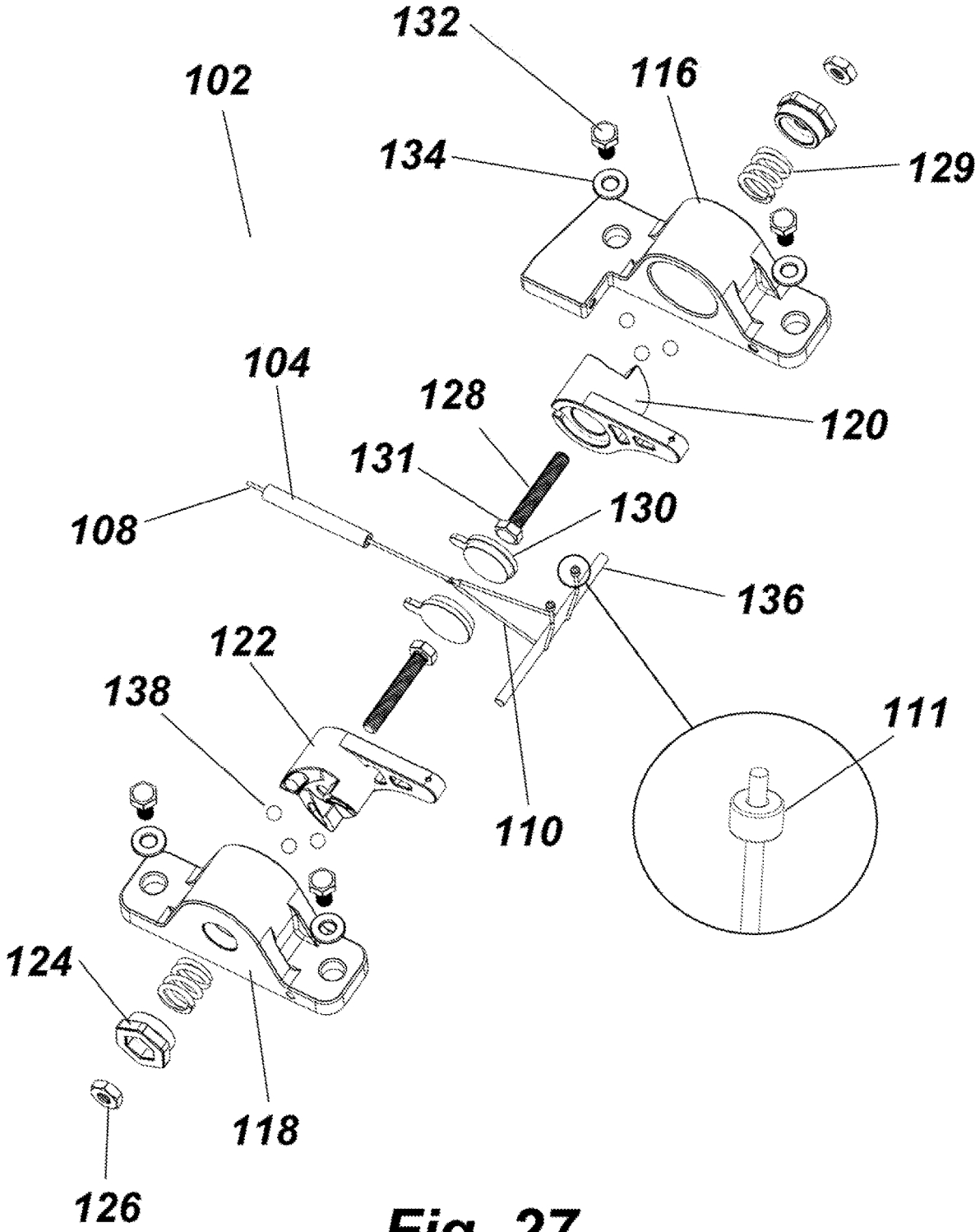
FIG. 27 is an exploded top perspective view of the brake caliper.
Figure 28:
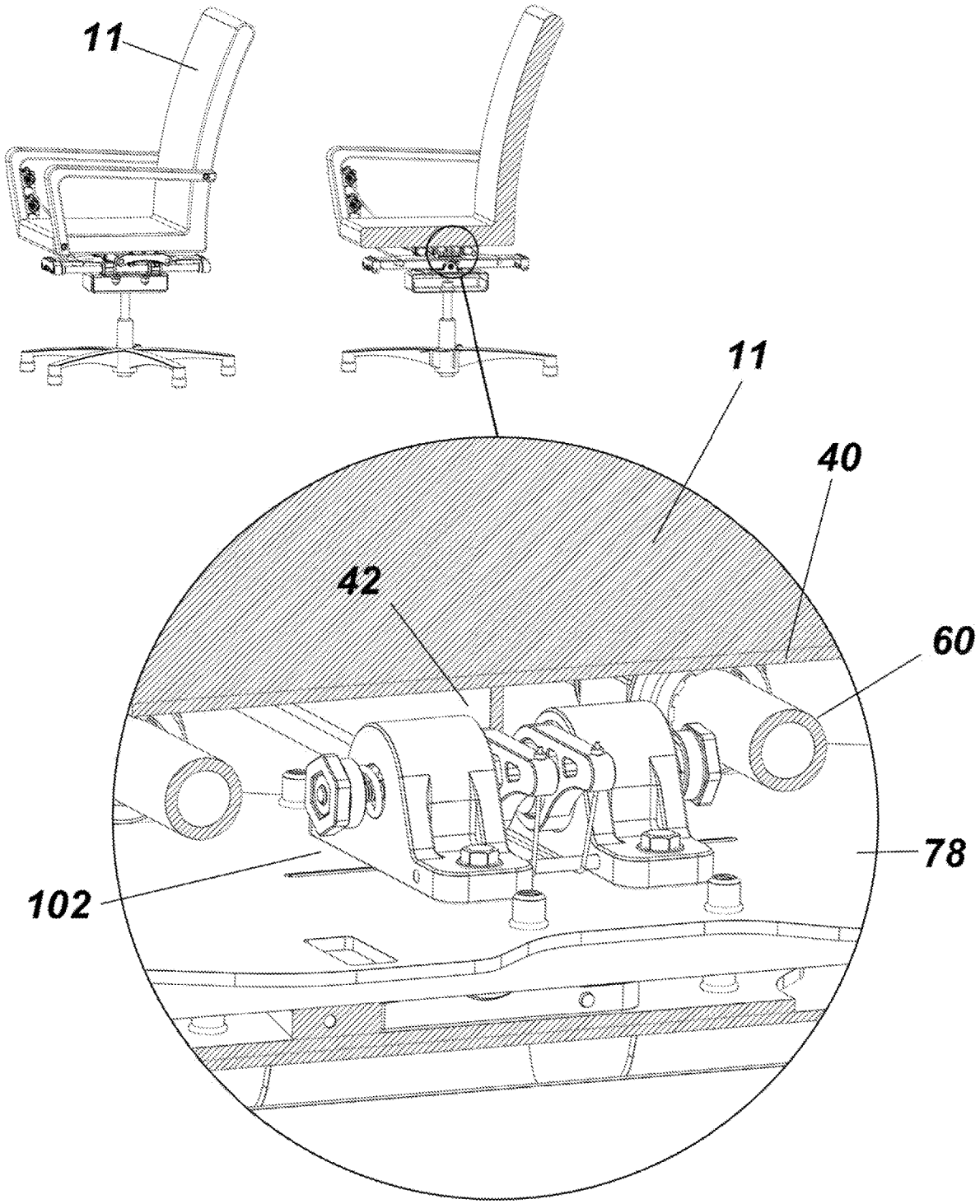
FIG. 28 is a partial cross-sectional view of the active chair showing position of the brake caliper with respect to the top and the middle plate.
Figure 29:
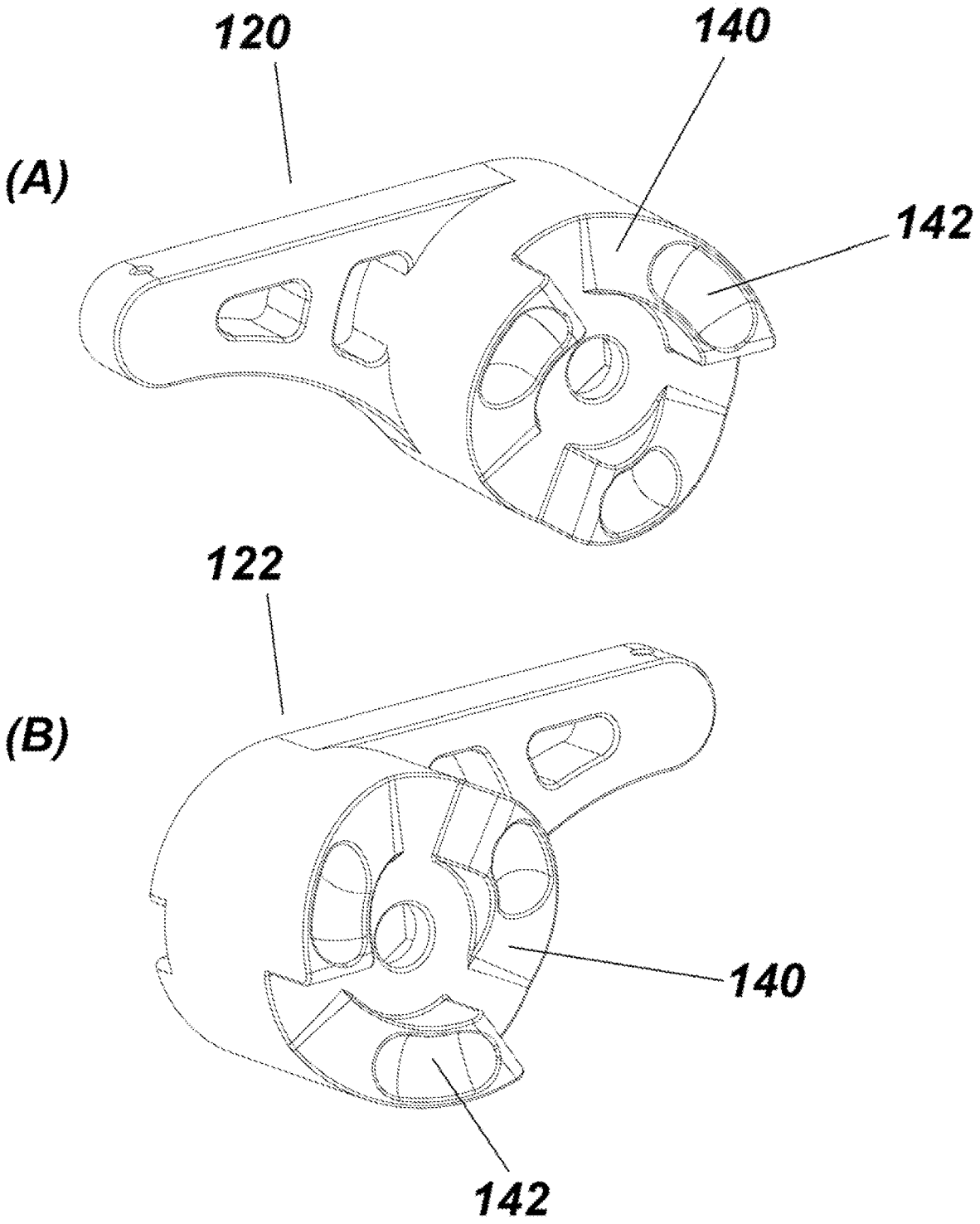
FIG. 29 is a top perspective view of the right (A) and left (B) caliper lever.
Figure 30:
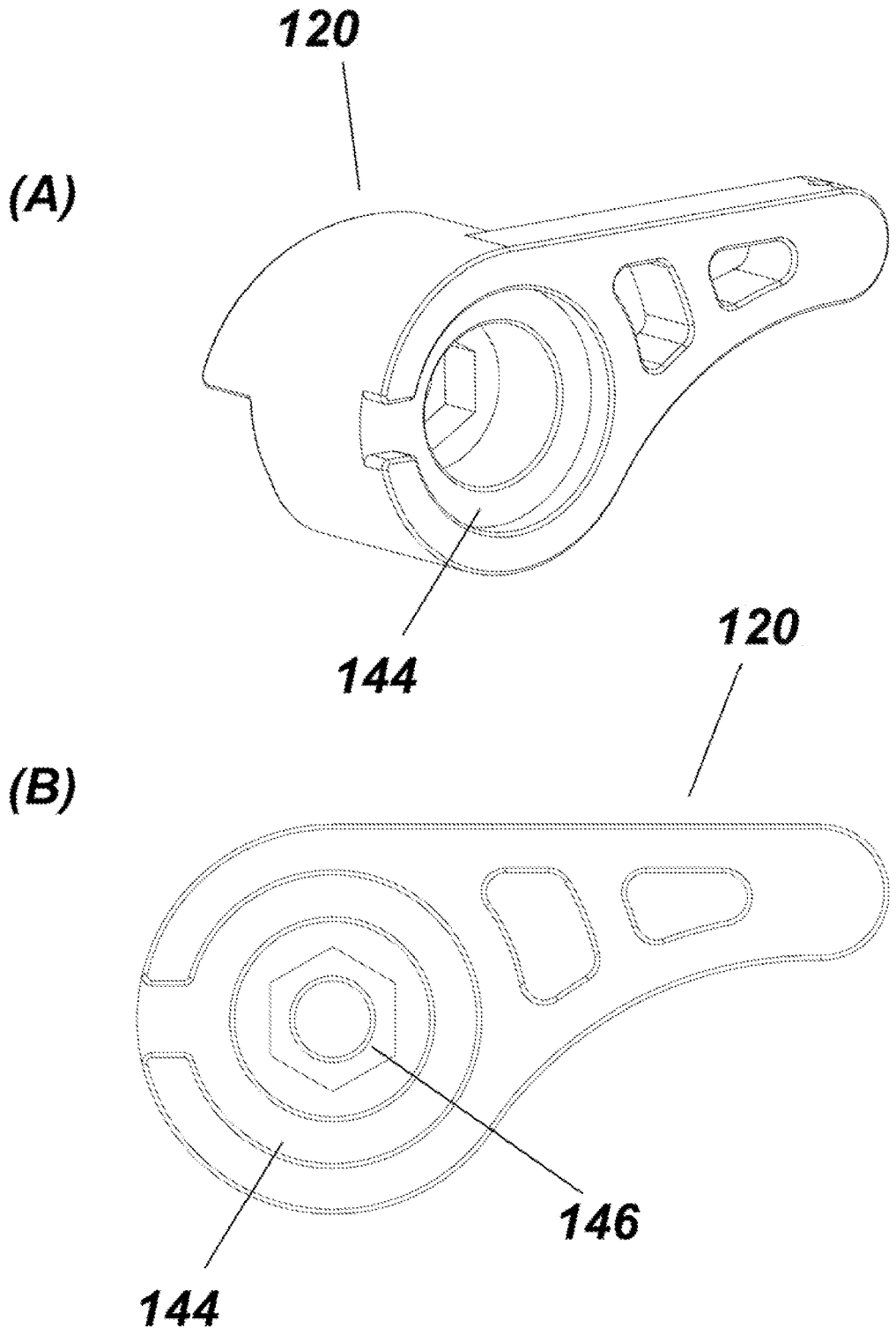
FIG. 30 is a perspective (A) and front (B) view of the right caliper lever.
Figure 31:
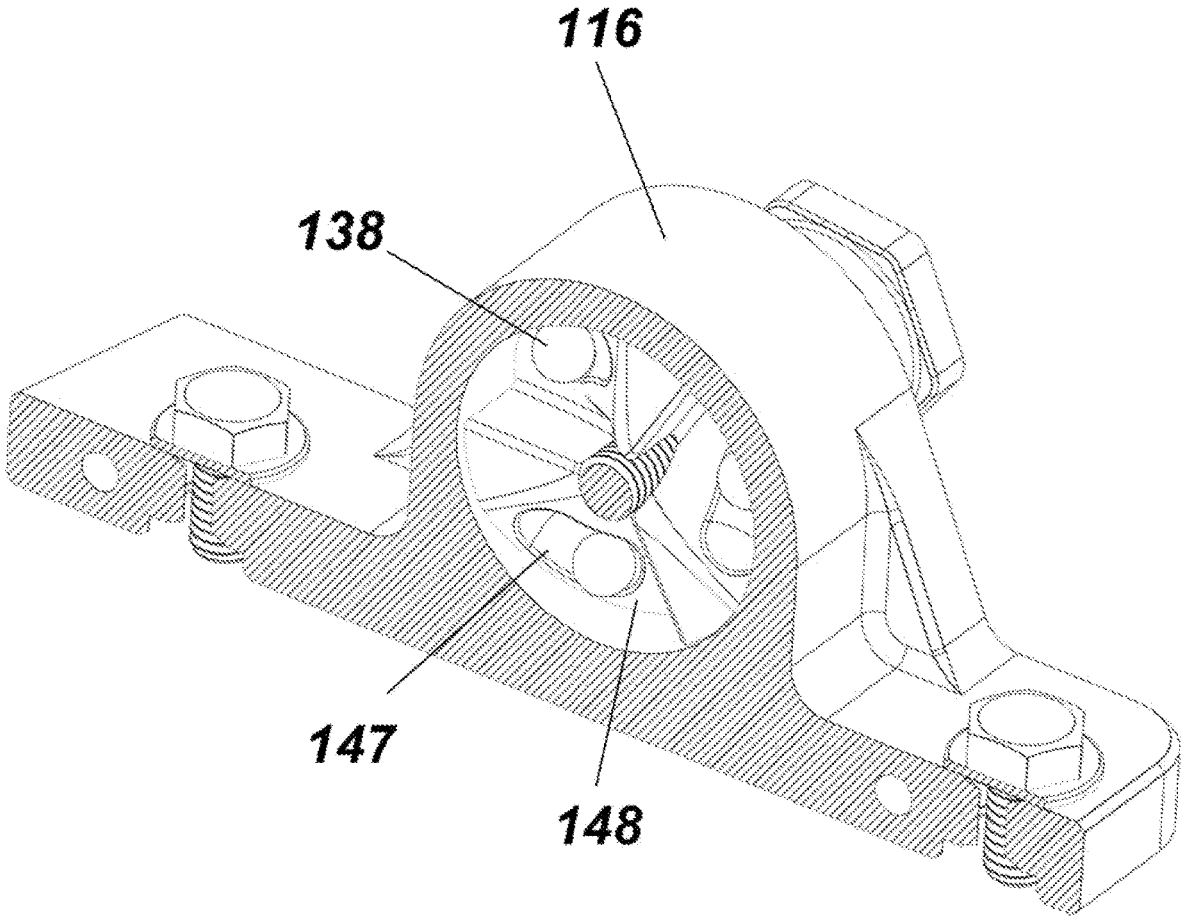
FIG. 31 is a cross-sectional view of the right brake caliper body.

Referring to FIGS. 21 to 23, the bottom plate assembly 24 consists of bottom plate 94, and four linear bearing housings 80. The four bearing housings 80 are aligned with the bottom plate 24 by the use of four rectangular cutouts 90. The rectangular extrusion 92 on each bearing housing 80 fit tightly in the rectangular cutouts 90 and assist in maintaining collinearity and parallelism of the linear bearing's 82 longitudinal axes. Bearing housings 80 are welded to the bottom plate 94. Four linear bearings 82 are inserted into four bearing housings 80 and held in place using two retaining rings 84 per each bearing 82. Four press-fit studs 96 and four screw nuts 98 are used to attach the bottom plate 94 to the chair tilter assembly 26.

Referring to FIGS. 14 to 17 and 21 to 23, the linear shaft assembly 18 described earlier and shown in FIGS. 8, and 14 to 17 interacts with bottom plate assembly 24. Four knobs 62 are attached to the bottom plate assembly 24 via four screws 66. The linear shaft assembly 18 is free to move with respect to the bottom plate assembly 24 facilitating front-to-back displacement. The four elastic elements 64 keep the linear shaft assembly 18 centered with respect to the middle plate assembly 22.

Referring to FIGS. 12, 18 to 21, 24, and 27, the brake system assembly 20 consists of hand controller 100 and brake caliper 102 connected via a bowden cable housing 104. It should be noted that there are a total of two brake system assemblies 20, one per right-to-left linear displacement and one per front-to-back displacement. One brake caliper 102 is attached to middle plate 78 and interacts with the transverse beam 42 of the top plate assembly 16 and the second brake caliper 102 is attached to the bottom plate 94 and interacts with the transverse beam 42 of the middle plate assembly 22. The only difference between the brake system assemblies 20 is in the bowden cable housing 104 routing in the brake caliper 102. Each brake caliper 102 is attached to its respective plate by four caliper screws 132 and four caliper washers 134 that screw into four rivet nuts 88. The brake system assembly 20 is operated by the controller knob 106 of the hand controller 100.

Referring to FIGS. 24 to 28, 31, and 34 to 35, turning the controller knob 106 clockwise winds up a high-strength rope 108 that connects to and pulls on the brake lever rope 110. The ends of the brake lever rope 110 attach to the right 120 and left 122 caliper levers. Pulling on the high-strength rope 108 rotates each caliper about its rotational axis 127. Due to the interaction of the caliper lever helical surface 140 with the caliper helical surface 148, this rotation causes a linear displacement towards the center of the brake caliper 102 as indicated by the arrows 188 in FIG. 34. The right 120 and left 122 caliper levers are the mirror image of each other with the right 120 caliper lever rotating clockwise and the left 122 caliper lever rotating counterclockwise. The same applies to the caliper helical surface 148 of the right 116 and left 118 caliper body. Each caliper lever 120 and 122 houses a brake pad 130 that is press fitted into the brake pad cavity 144. Upon lever 120 and 122 linear displacement towards the center, the brake pads 130 come into contact with the transverse beam 42 and apply friction.

Referring to FIGS. 7, 10, 24, 33, and 35, each incremental rotation of the controller knob 106 increases the friction between the brake pads 130 and the transverse beam 42 providing incremental resistance to movement until such friction that disables all movement completely is reached. Movement can be completely disabled at any position within the movement boundary 33. The mechanical force from the controller knob 106 to the brake caliper 102 is transferred by the bowden cable housing 104. The bowden cable housing 104 can be routed straight 150 or to the side 152 to ensure an optimal and shortest path to the hand controller 100 attached to the armrest 12.

Figure 32:
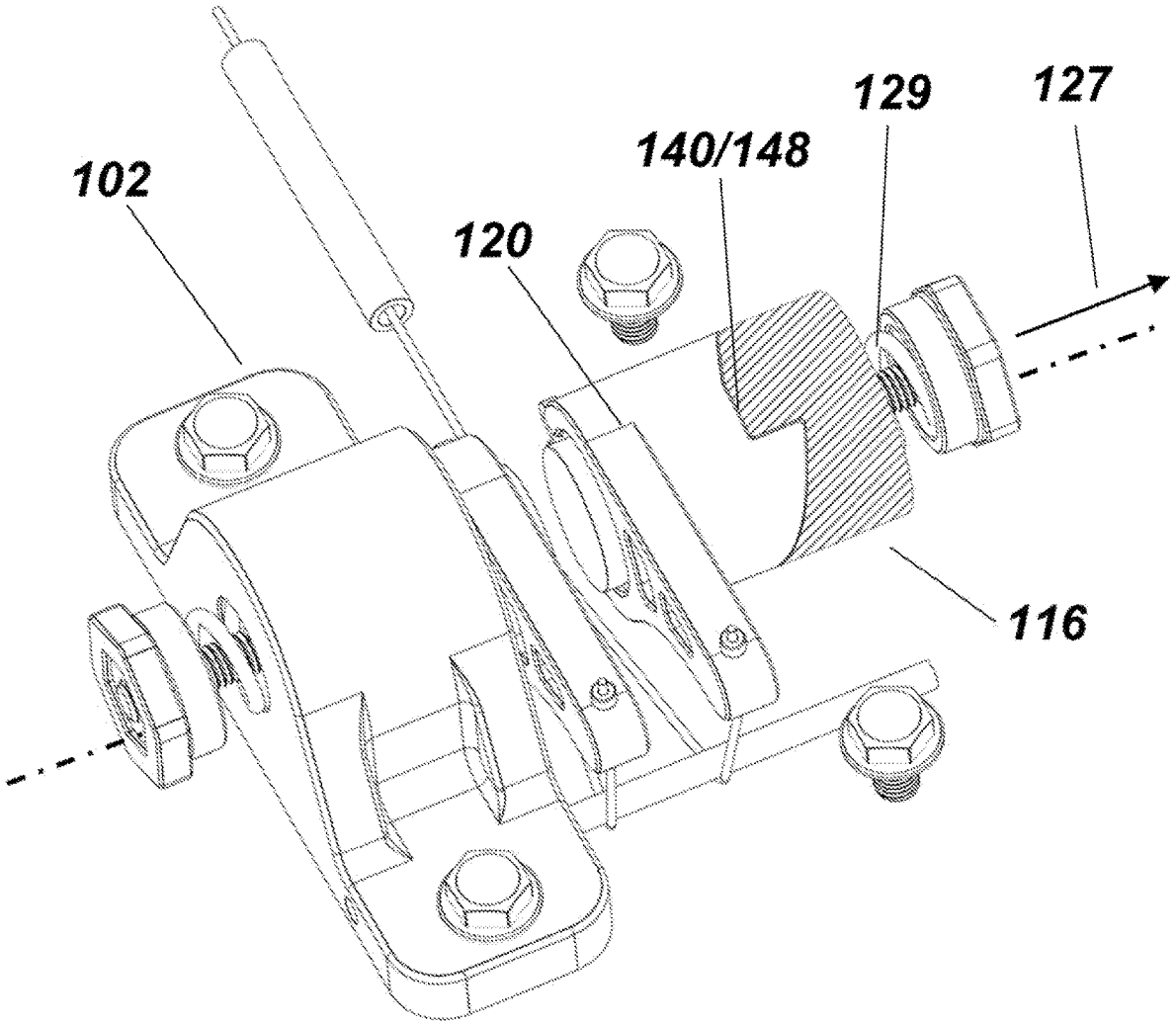
FIG. 32 is a top view of the brake caliper 102 with cross-sectional view of the right caliper body.
Figure 33:
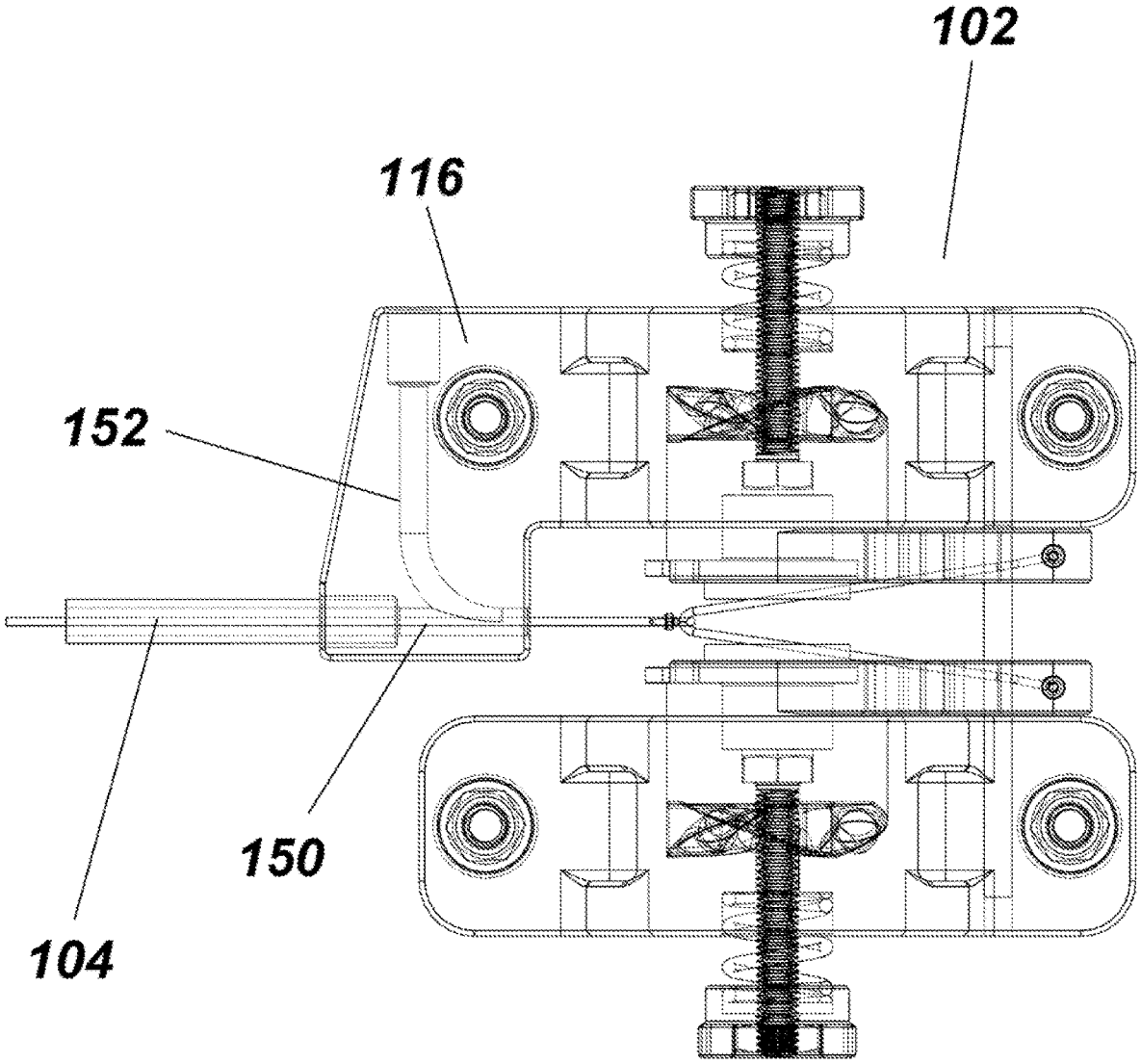
FIG. 33 is a top view of the brake caliper with all drawing lines visible.
Figure 34:
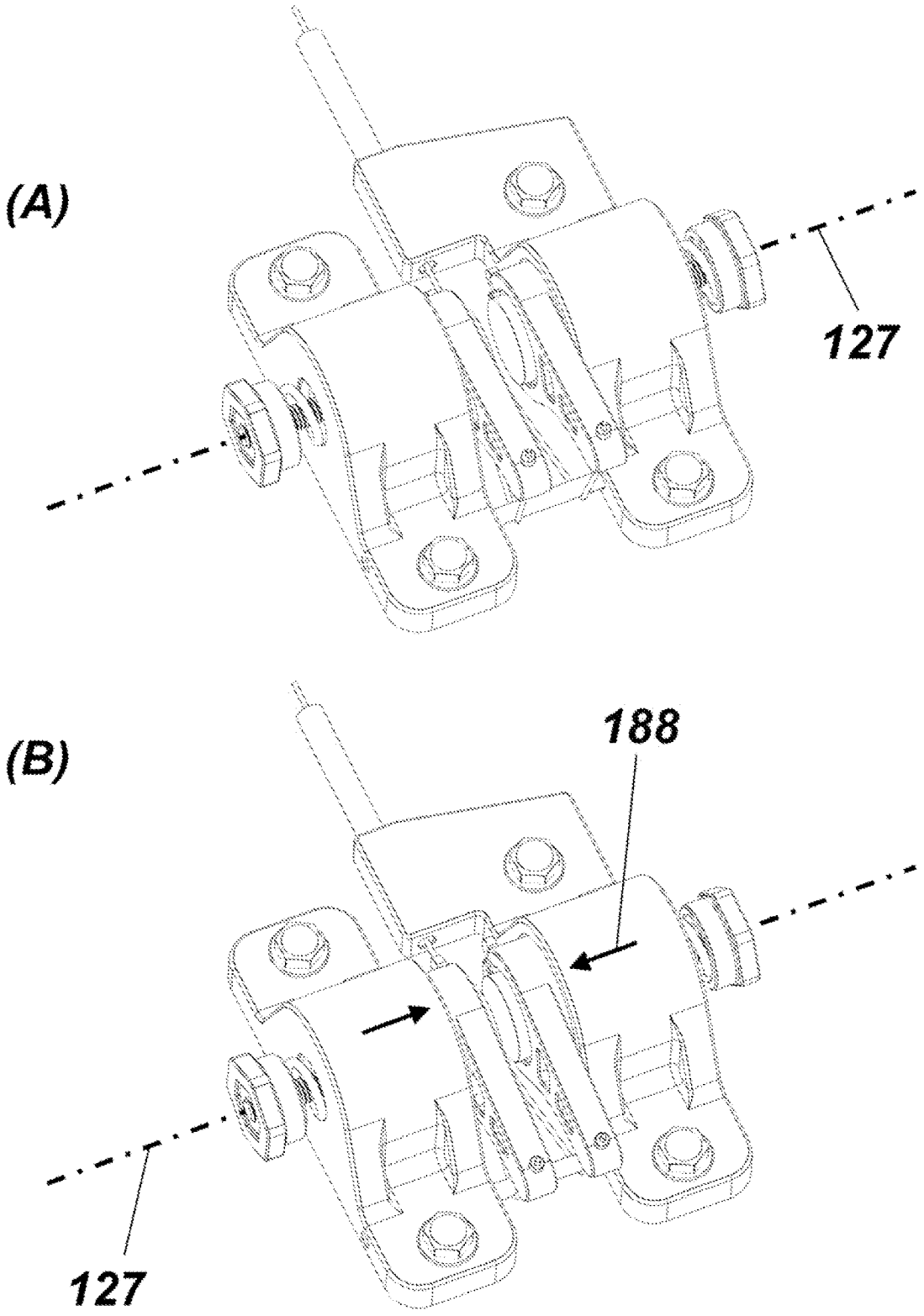
FIG. 34 is a top perspective view of the brake subassembly in an open non-braking state (A) and closed braking state (B)
Figure 35:
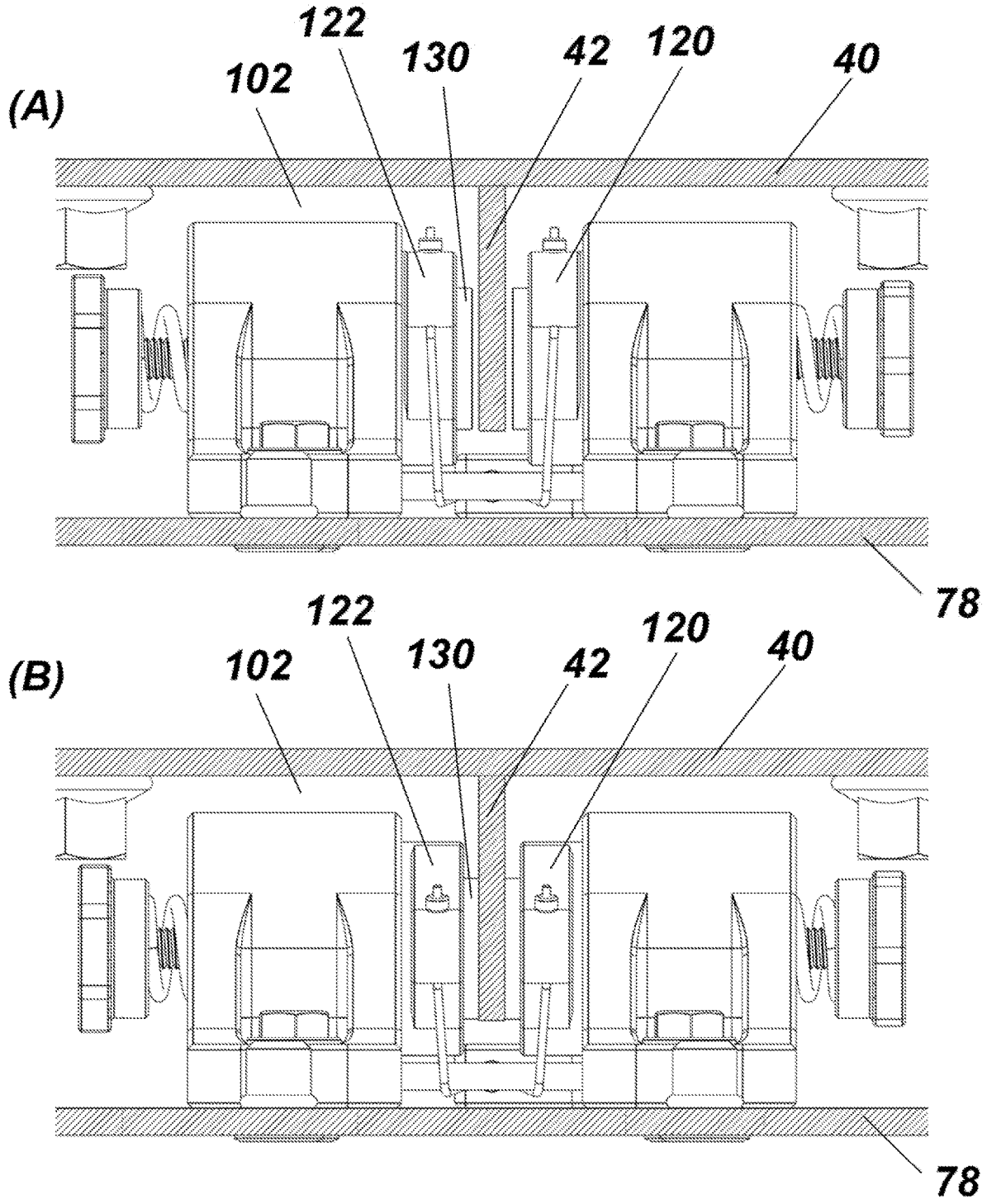
FIG. 35 is a cross-sectional view of the chair showing brake subassembly and its interaction with transverse beam in its braking (A) and non-braking (B) state.
Figure 36:
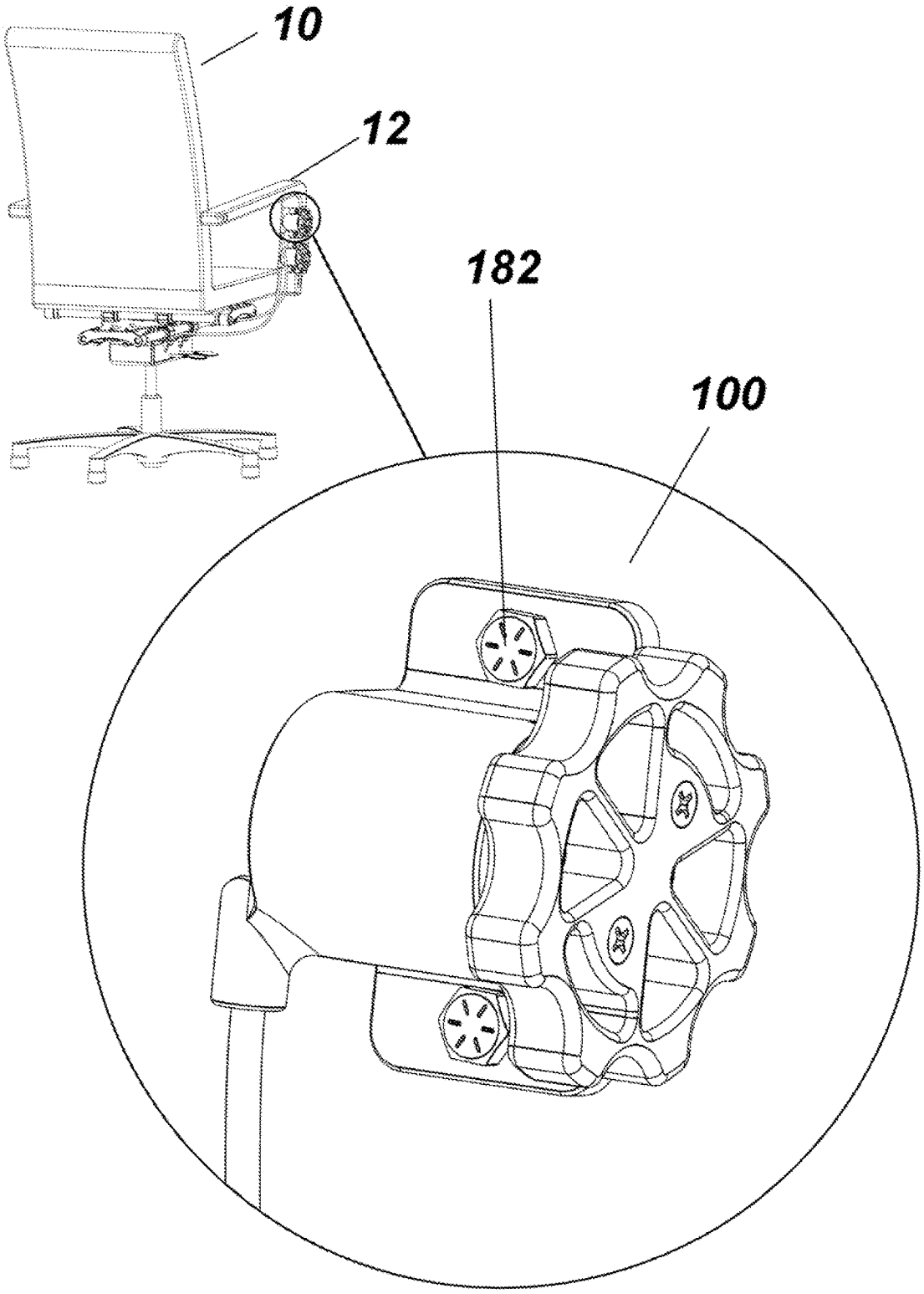
FIG. 36 is a back perspective view of the office chair seat assembly and a detail showing the orientation of the hand controller.
Figure 37:
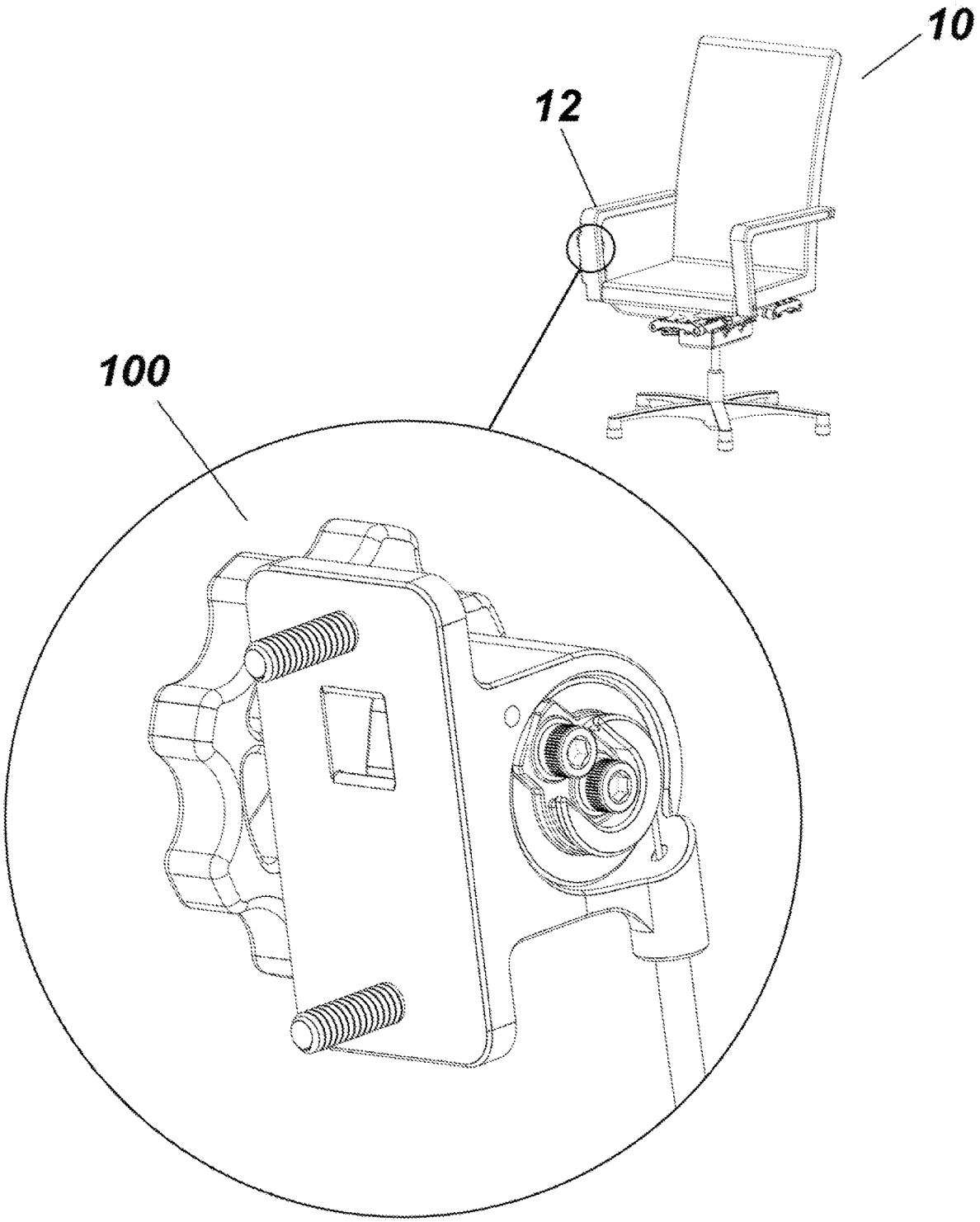
FIG. 37 is a front perspective view of the office chair seat assembly and a detail showing the orientation of the hand controller.
Figure 38:
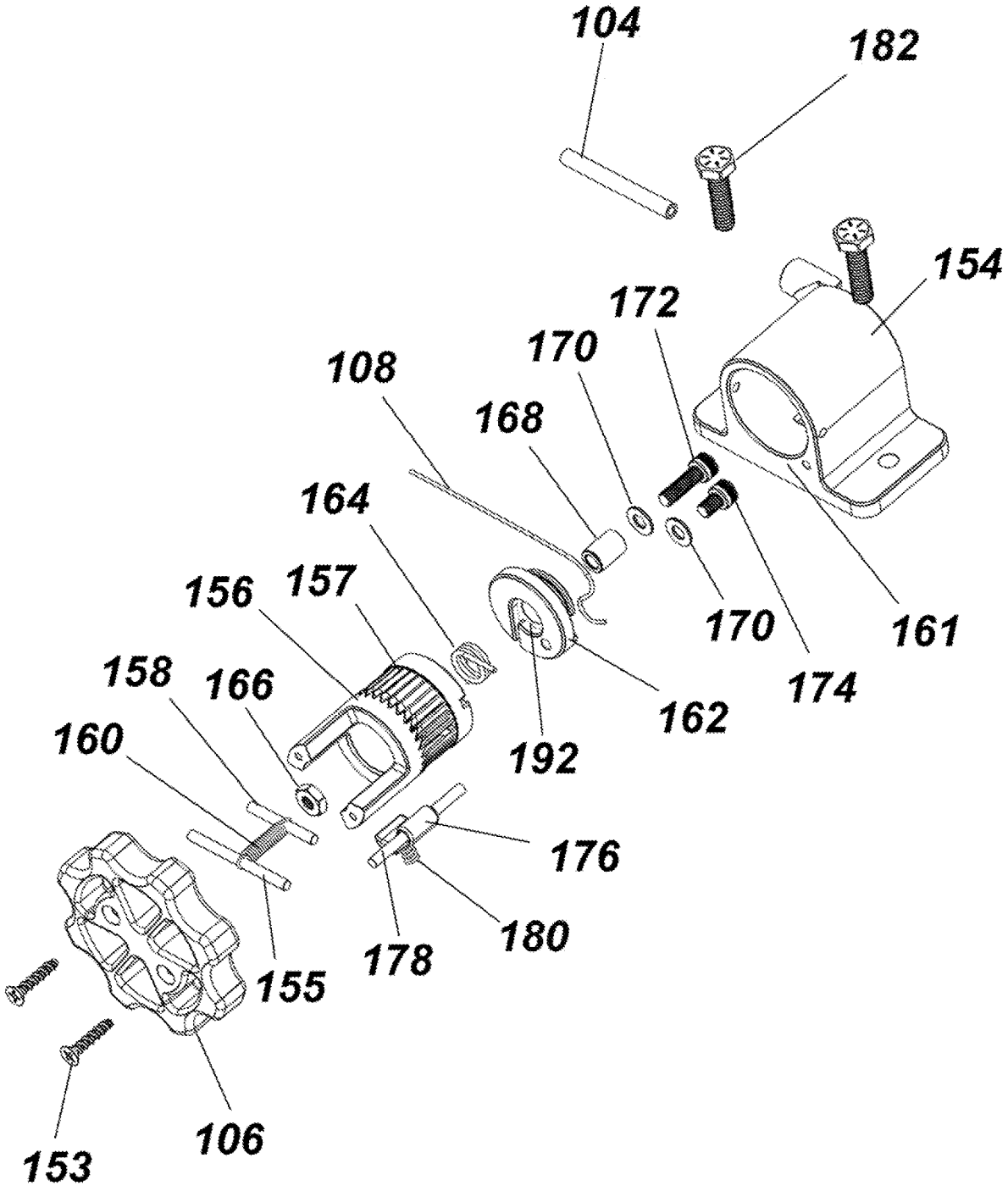
FIG. 38 is an exploded top front perspective view of the hand controller.
Figure 39:
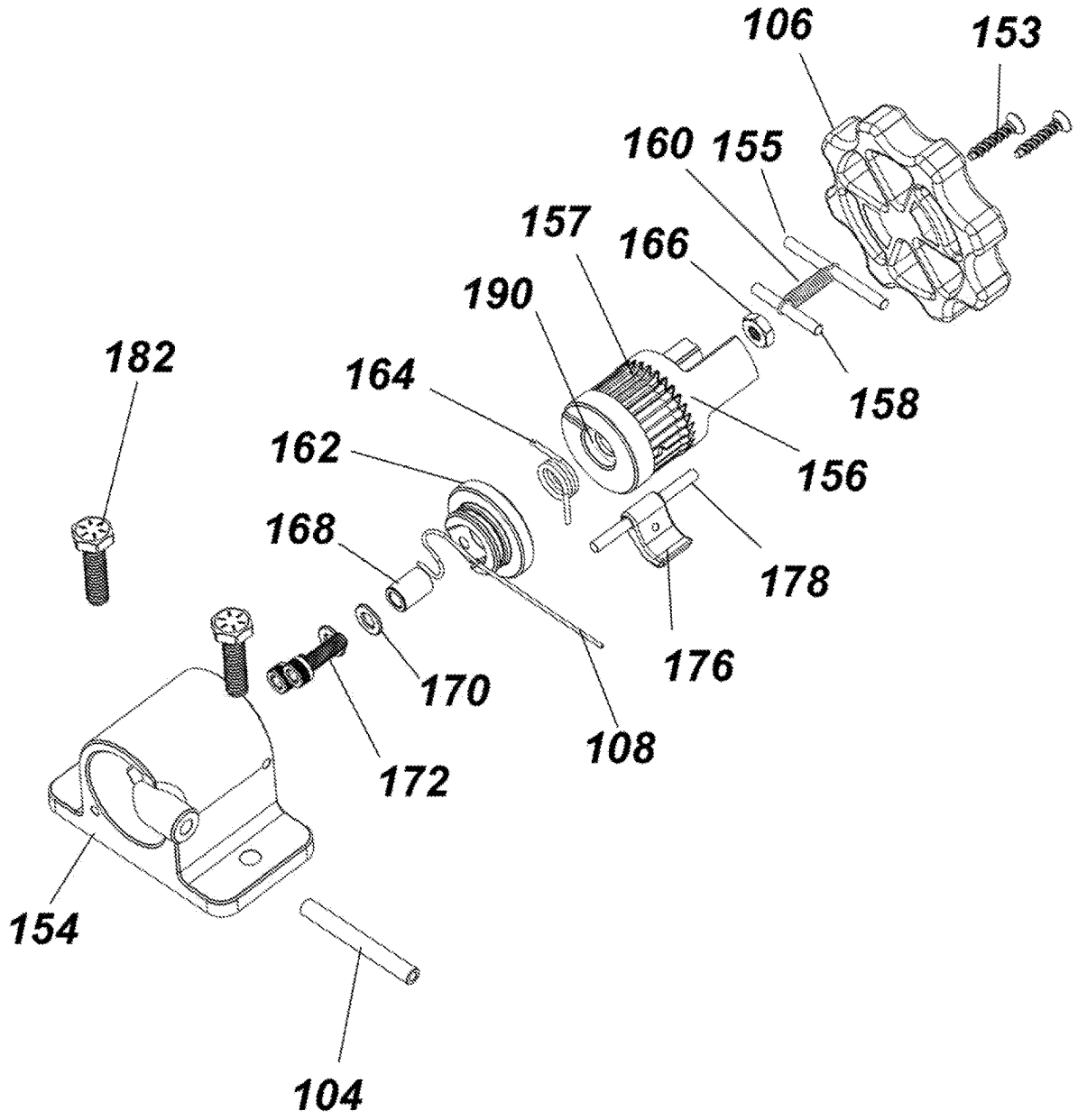
FIG. 39 is an exploded top back perspective view of the hand controller.
Figure 40:
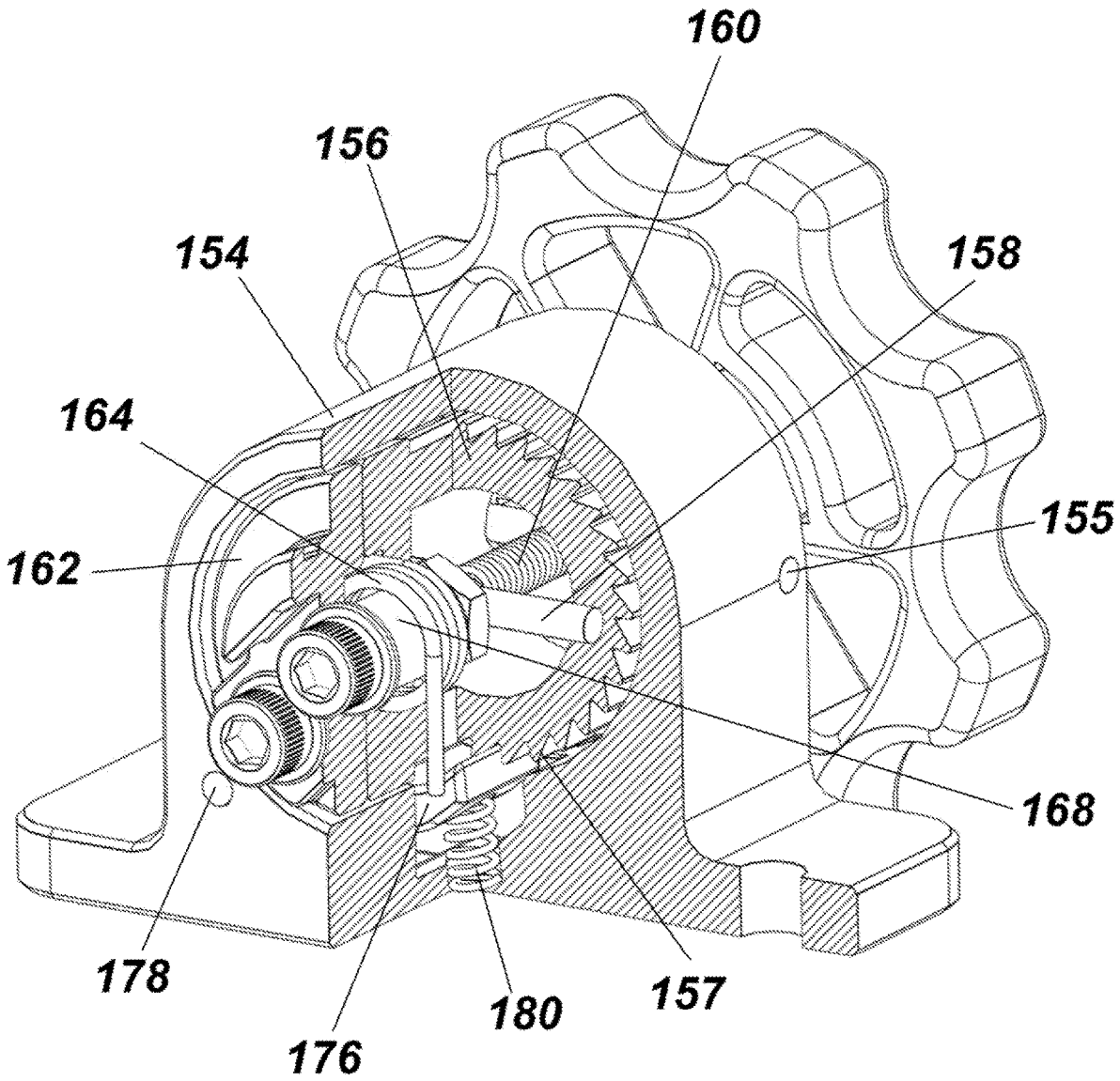
FIG. 40 is a zonal cross-sectional perspective view of the hand controller.
Figure 41:
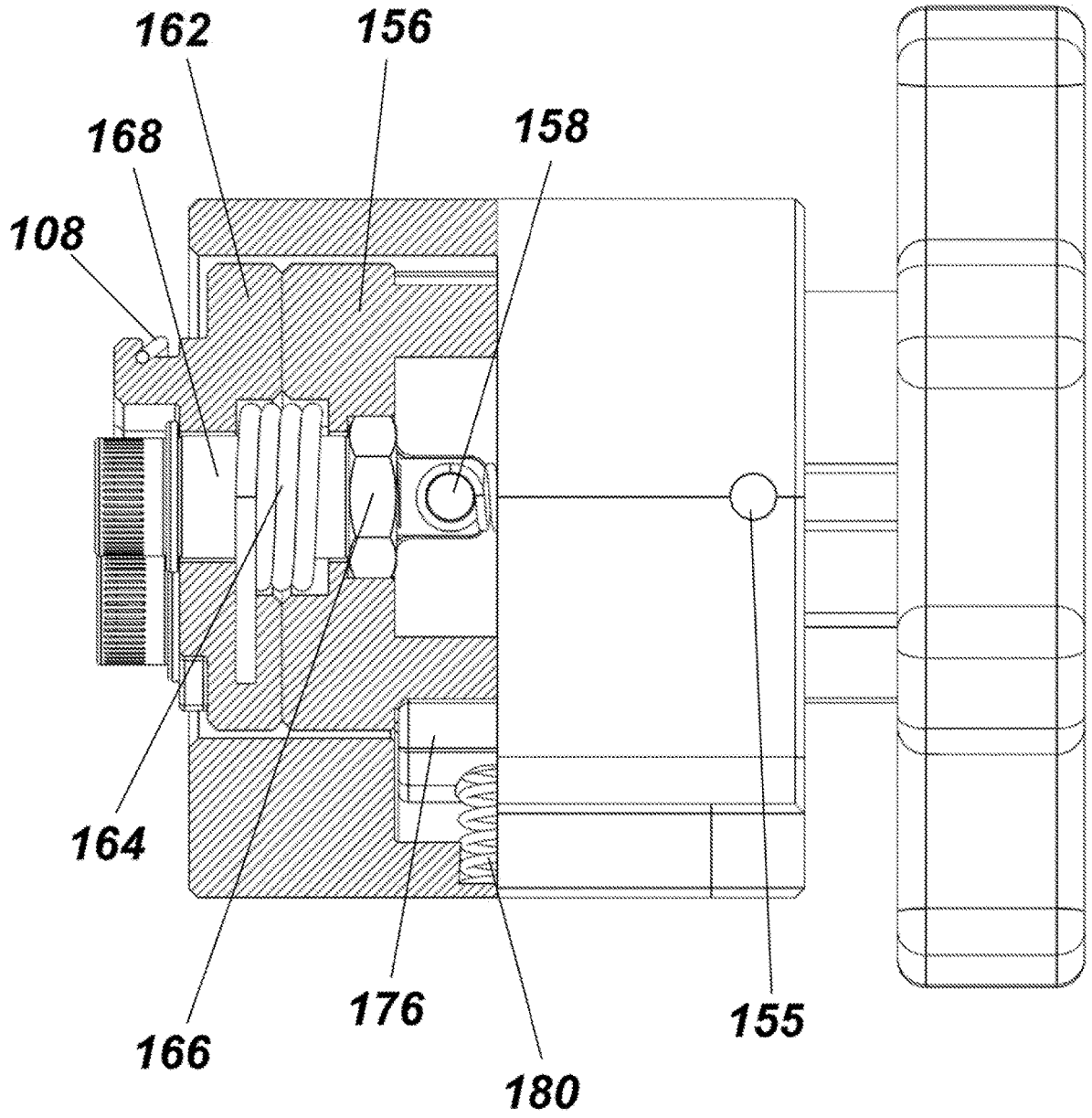
FIG. 41 is a partial zonal cross-sectional side view of the hand controller.
Figure 42:
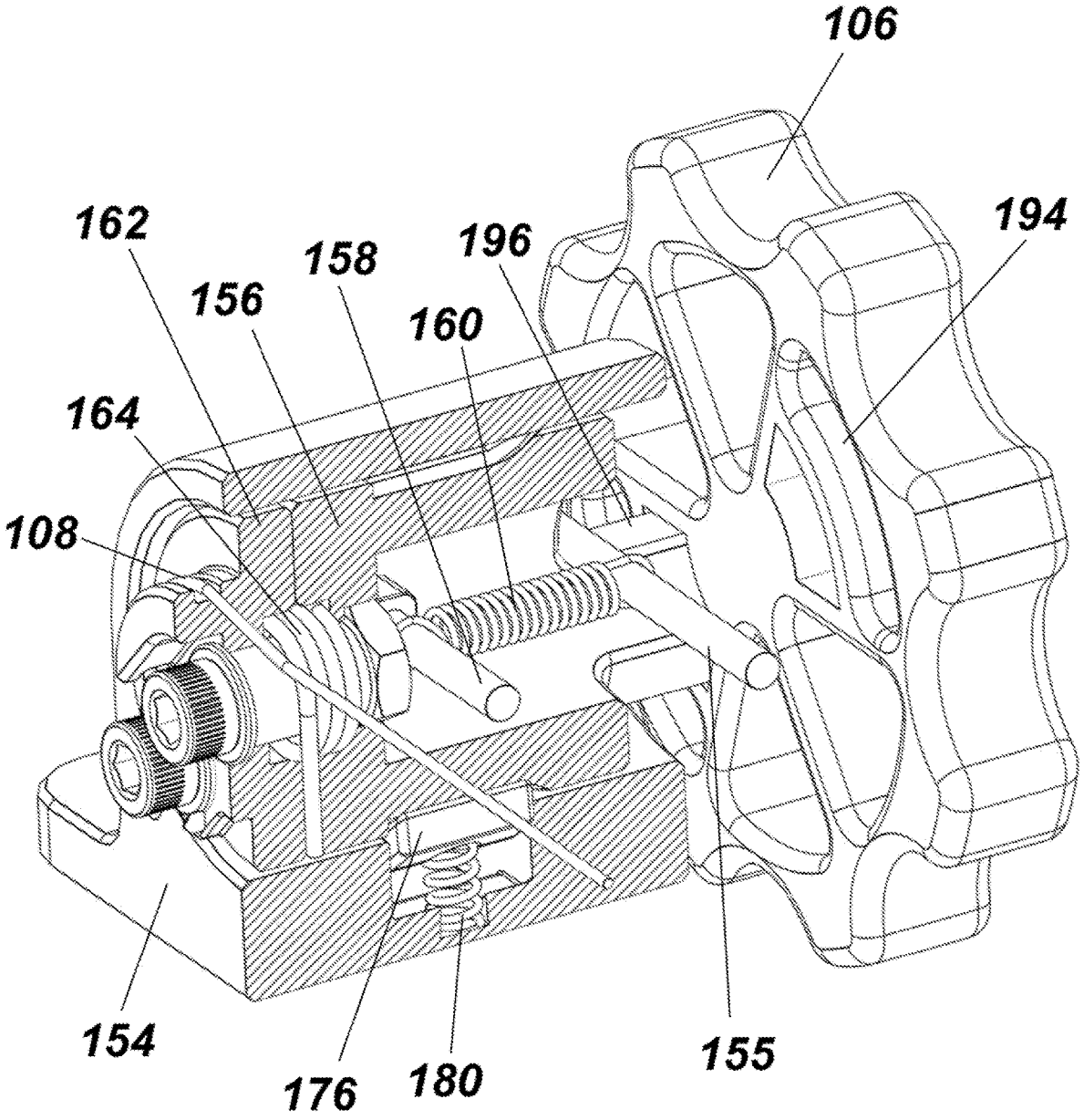
FIG. 42 is a partial cross-sectional perspective view of the hand controller.

Referring to FIGS. 25 to 35, the right 116 and left 118 caliper housings house right 120 and left 122 caliper levers, respectively. Each caliper lever 120 and 122 is held in a neutral (i.e., non-rotated) position by a return spring screw 128, return spring 129, return spring cap 124, and a return spring nut 126. When installed, return spring 129 is in a compressed state and pushes against the caliper body 116 and 118 thus forcing the return spring cap 124 in the outward direction 125 (FIG. 32). The hexagonal head 131 of the return spring screw is embedded within the hex cavity 146 of the caliper lever 120 and 122. The compressed return spring 129 thus applies force through the hexagonal head 131 onto the caliper lever 120 and 122 pushing it inward into the caliper body 116 and 118 and into its natural position where the caliper lever helical surface 140 meshes with caliper helical surface 148 as seen in FIG. 32. Each additional caliper lever 102 and 122 linear displacement further compresses the return spring 129. Upon release, the return spring 129 forces the lever 102 and 122 back to its neutral position. The helical surfaces 140 and 148 are lubricated using a standard silicon grease to reduce friction. Additionally, three plastic bearing balls 138 per caliper lever 120 and 122 are used to further reduce friction between helical surfaces 140 and 148 and to prevent over rotation. Each bearing ball 138 is positioned inside of the lever 142 and caliper bearing ball cavity 147. The lever 142 and the caliper bearing ball cavities 147 are located on the caliper lever 140 and caliper helical surface 148, respectively, and are rotated by 22.5 degrees with respect to each other to allow for bearing ball 138 rolling instead of dragging.

Referring to FIGS. 25 to 28, the high-strength rope 108 connects to and pulls on the brake lever rope 110. The ends of the brake lever rope 110 attach to the right 120 and left 122 caliper levers by the use of metal sleeves 111. The brake lever rope 110 is routed to the bowden cable housing 104 by the use of caliper dowel pin 136. The routing also ensures that the pull force exerted by the caliper lever rope 110 onto the caliper levers 120 and 122 is applied at a mechanically advantageous angle. The high-strength rope looped end 112 is created by the use of metal sleeve 114 and the brake lever rope 110 passes through the looped end 112. The looped end 112 is loose enough to allow travel along caliper lever rope 110 allowing the pull force to be applied to one or the other lever independently shall one become unable to be displaced. This scenario has advantages in case of a misalignment of the transverse beam 42 with respect to the brake caliper 102 (i.e., the transverse beam 42 is closer to one brake pad 130 than the other).

Referring to FIGS. 9 to 10, and 36 to 37, the hand controller 100 attaches to the expanded surface 34 of the armrest 12 using two screws 182 that fit in the holes 36. There are two screws 182 required per hand controller 100 and two hand controllers 100 are installed one above another. The position of hand controllers 100 is interchangeable and can be configured based on user preference (i.e., the top hand controller 100 can act as a resistance or brake for the front-to-back displacement and the bottom controller 100 can act as a resistance or brake for the right-to-left displacement or vice versa).

Referring to FIGS. 36 to 46, one hand controller 100 per linear displacement (i.e., right-to-left and front-to-back) is used. Hand controller 100 operates as a ratchet and pawl mechanism. The controller knob 106 turns only one-way clockwise unless the knob 106 is pushed against the front wall 161 of the hand controller body 154. A pawl 176 that rotates around the pawl dowel pin 178 is pushed upon by a pawl spring 180 that forces the pawl 176 to mesh with ratchet gears 157 thus preventing a counterclockwise rotation of the ratchet body 156. When the hand controller knob 106 is pushed inwards in the direction of the arrow 202 (FIG. 45) towards the front wall 161 of the hand controller body 154, the pawl 176 follows the pawl cam path 184 which disengages the pawl 176 from the ratchet gears 157 and the pawl 176 lays on the ratchet smooth round surface 186. In this pawl 176 position 206, the ratchet body 156 is allowed to rotate counterclockwise and can return to its original position. Opposing that is pawl 176 position 204, which prevents the ratchet body 156 to rotate counterclockwise.

The hand controller body dowel pin 155 is embedded in the hand controller body 154 only. The ratchet dowel pin 158 is embedded in the ratchet body 156 only. Ratchet return spring 160 is preloaded in its natural position with one end attaching to the hand controller body dowel pin 155 and the other to ratchet dowel pin 158. Upon pushing the controller knob 106 in the direction of the arrow 202, the ratchet return spring 160 is stretched and exerts force upon the ratchet body 156 in the opposing direction of the arrow 202. Upon controller knob 106 release, the ratchet return spring 160 returns the ratchet to its neutral position where the ratchet flat 198 rests against the hand controller body dowel pin 155. The hand controller body dowel pin 155 also prevents the mechanism (i.e., ratchet spool 162 and ratchet body 156) from completely exiting the hand controller body 154.

Figure 43:
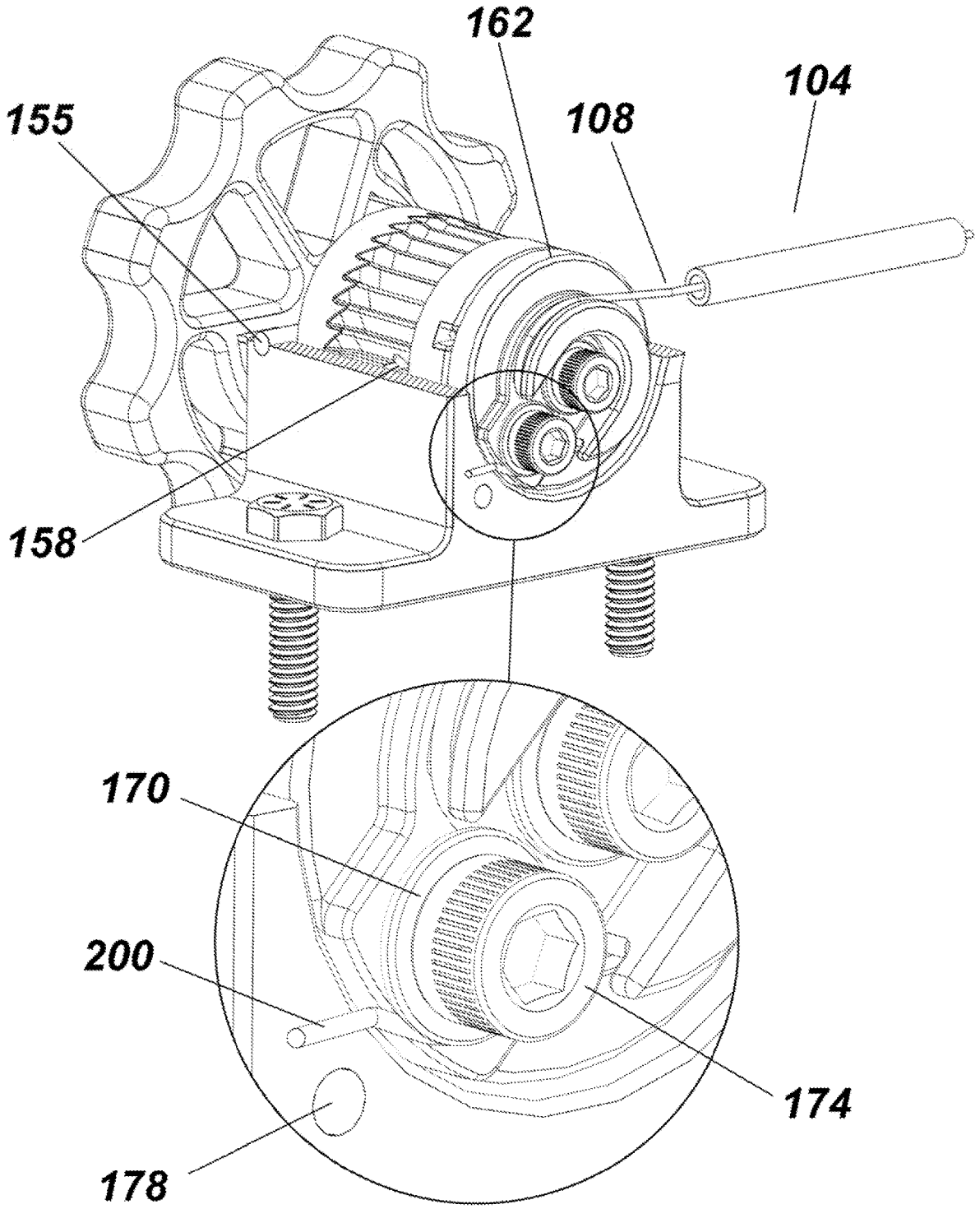
FIG. 43 is a partial cross-sectional perspective view of the hand controller with a detail showing the termination of the high-strength rope.
Figure 44:
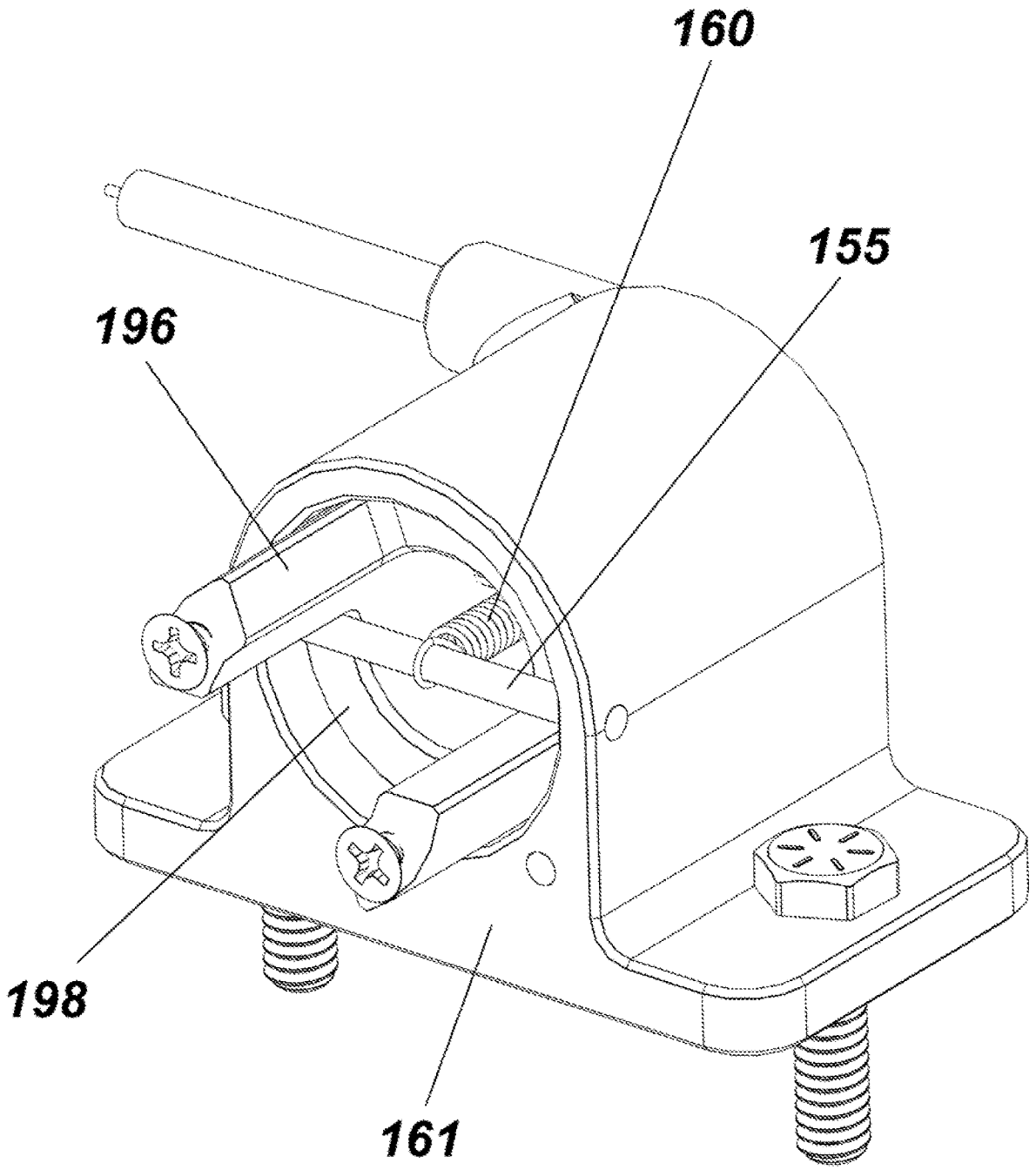
FIG. 44 is a perspective view of the hand controller without the controller knob.
Figure 45:
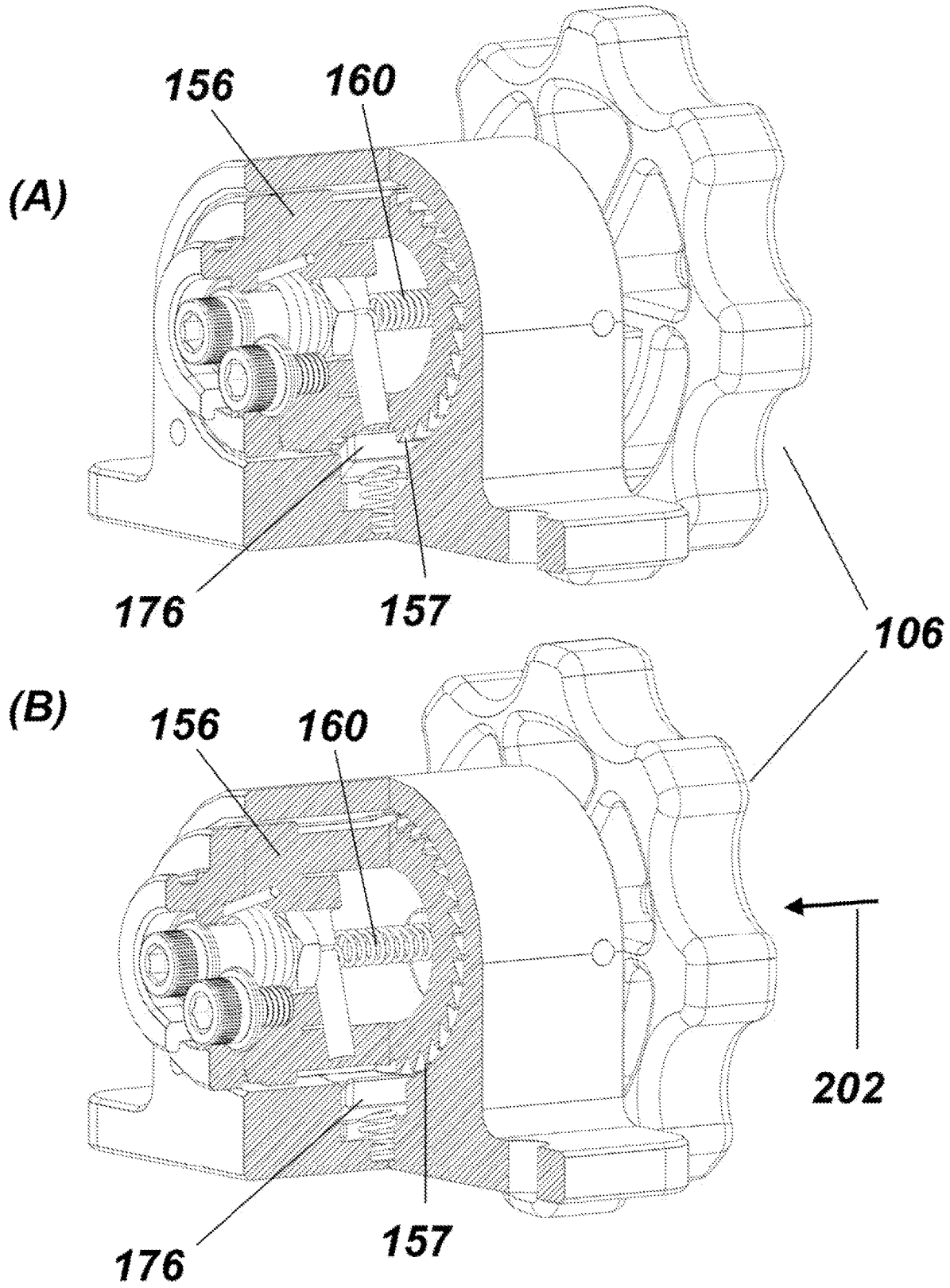
FIG. 45 is a partial zonal cross-sectional view of the hand controller showing the pawl engaged (i.e., engaged state; A) and disengaged with the ratchet gears (i.e., release state; B)
Figure 46:
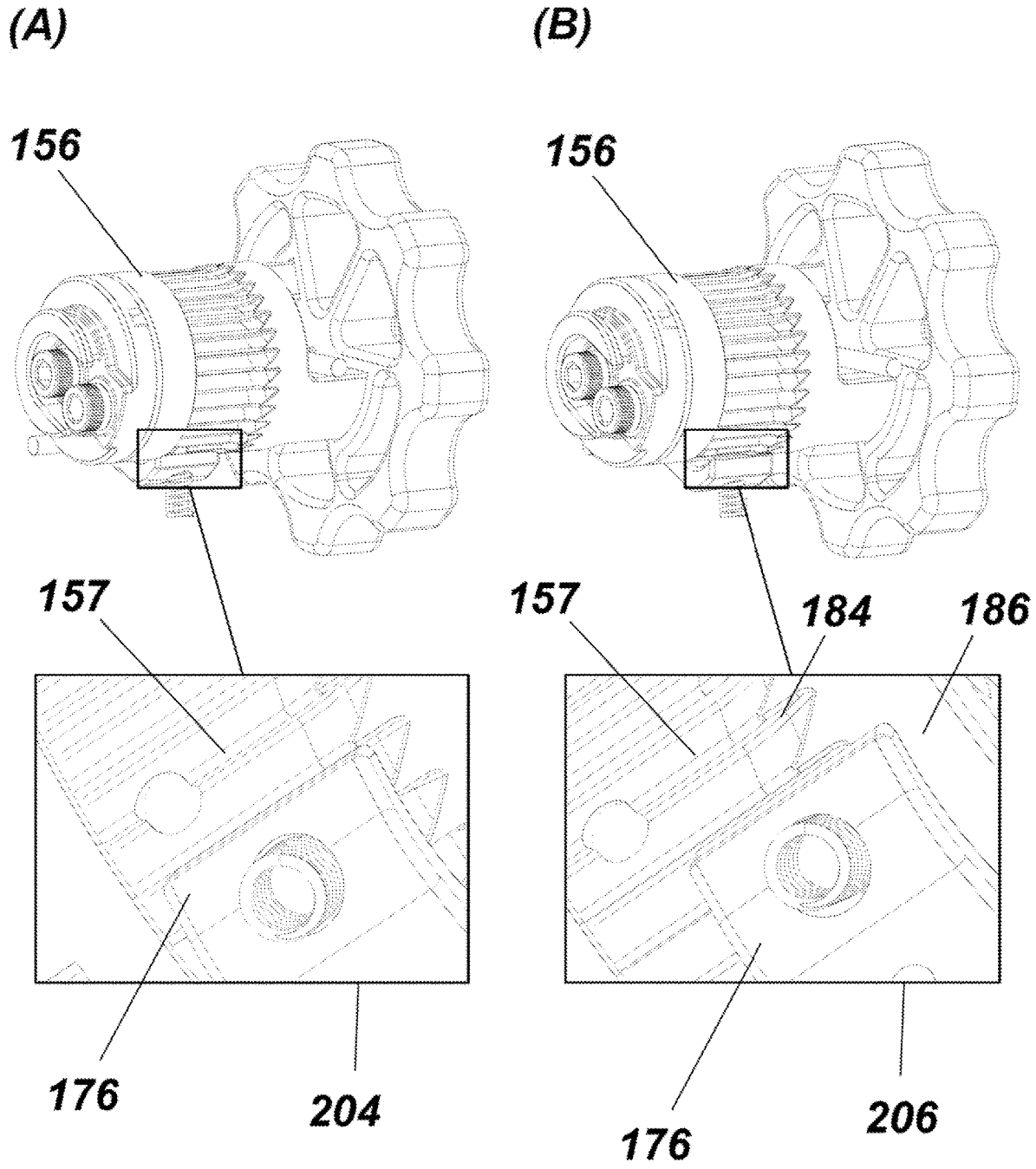
FIG. 46 is a back perspective view of the hand controller without the hand controller body showing detail of the pawl engaged (A) and disengaged (B) with the ratchet gears.

Referring to FIGS. 27 and 36 to 46, turning the controller knob 106 winds up the high-strength rope 108 that passes through the bowden cable housing 104 onto the ratchet spool 162. This creates the pulling force responsible for rotating the caliper levers 120 and 122. The hand controller body 154 houses the ratchet body 156 and ratchet spool 162. The ratchet spool 162 is attached to the ratchet body 156 by the ratchet screw 172, the washer 170, and the ratchet nut 166. The ratchet spacer 168 ensures that the ratchet body 156 and the ratchet spool 162 are not compressed together allowing the ratchet spool 162 to rotate with respect to the ratchet body 156. The ratchet overload torsion spring 164 is positioned within the ratchet 190 and the spool 192 torsion spring cavity with one leg of the spring in each cavity. The controller knob 106 attaches to the ratchet body 156 by the two ratchet standoffs 196 that fit inside the knob cavity 194 and the controller knob 106 is further secured by two controller knob screws 153. The rotation of the controller knob 106 is limited to 110 degrees by the interaction of the hand controller body dowel pin 155 and ratchet body standoffs 196 as seen in FIG. 44. While the amount of controller knob 106 rotation required to induce braking or complete stoppage (i.e., brake pads apply friction onto transverse beam 42) is much less, the ratchet overload torsion spring 164 allows the controller knob 106 to rotate the full 110 degrees without inducing damage to neither the brake caliper 102 nor the hand controller 100. This is accomplished through controlling the maximum applied force by selecting a spring value k of the torsion spring 164 that prevents the force to exceed the limit beyond which either component of the brake system assembly 20 might become damaged. The ability to turn the controller knob 106 fully also provides positive feedback to the user indicating that the brake system assembly 20 is now fully engaged. When pressed in, the controller knob 106 tends to rotate back counterclockwise to its original position through a force that is generated onto the high-strength rope 108 by the two return springs 129.

Referring to FIG. 43, the high-strength rope 104 is attached to the ratchet spool 162 by being sandwiched between the washer 170 and the ratchet spool body. The high-strength rope 108 can be tensioned by hand by lightly pulling on the spool end of the high-strength rope 200 before fastening the spool screw 174.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more" or "at least one." The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

All patents and publications mentioned in this specification are indicative of the levels of those skilled in the art to which the invention pertains. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An active chair comprising:

a chair assembly formed from a seat portion, a backrest portion extending upward from said seat portion, a base supporting said seat portion and said backrest portion, a plurality of legs attached to said base for holding said chair assembly, a height adjustable mechanism including a gas cylinder allowing vertical adjustment of said seat portion relative to said base, said base further defined as a top plate assembly formed from a top plate, a transverse beam, and four angled beams, said transverse beam interlocks with said top plate by use of six locating cut-outs in said top plate and six extrusions on said transverse beam, said top plate assembly mounted onto a linear shaft assembly having a middle plate assembly mounted onto said linear shaft assembly, said middle plate assembly includes a middle plate, four linear bearing housings, a transverse beam, and four angled beams, said transverse beam interlocks with said middle plate by use of six locating cut-outs in said middle plate and six extrusions on said transverse beam, wherein said chair seat assembly is capable of front-to-back or right-to-left linear displacements, or a combination thereof;

a first brake assembly having a first hand controller and a brake caliper connected via a first bowden cable housing mounted onto said middle plate assembly constructed and arranged to interact with said transverse beam of said top plate assembly providing braking or complete stop for right-to-left linear displacement; and a second brake assembly having a second hand controller and a brake caliper connected via a second bowden cable housing mounted onto said bottom plate assembly constructed and arranged to interact with said transverse beam of said middle plate assembly providing braking or complete stop for front-to-back linear displacement.

2. The active chair according to claim 1, wherein each said right-to-left linear displacement or said front-to-back linear displacement can be locked in a fixed position by either said first brake assembly or said second brake assembly.

3. The active chair according to claim 1, wherein displacement of said seat can be performed individually or in combination wherein the center of said chair can move anywhere within a movement boundary, said movement boundary is fixed with respect to said bottom plate assembly, said tilter assembly, said gas cylinder, and said chair base whereas the center of said chair is free to move with respect to said bottom plate assembly, said office chair tilter assembly, said gas cylinder, and said chair base.

4. The active chair according to claim 1, wherein said transverse beam and said angled beams are coupled to said top plate to increase structural stability of said top plate.

5. The active chair according to claim 1, wherein two linear shaft connectors attached to said top plate assembly house two linear shafts, said linear shafts slide through four linear bearings to keep said linear shafts in alignment.

6. The active chair according to claim 1, wherein said linear shaft assembly is constructed to move with respect to said middle plate assembly facilitating right-to-left displacement.

7. The active chair according to claim 1, wherein said linear shaft assembly is centered with respect to said middle plate assembly by four elastic elements mounted in a pretensioned state.

8. The active chair according to claim 1, wherein said transverse beam and said angled beams are welded to said middle plate to increase structural stability of said middle plate.

9. The active chair according to claim 8, wherein rectangular extrusions on each said bearing housing fit tightly in rectangular cutouts disposed on said middle plate to assist in maintaining collinearity and parallelism of the longitudinal axis of said linear bearings.

10. The active chair according to claim 1, wherein said bottom plate includes a bottom plate and four linear bearing housings aligned with said bottom plate, each said bearing housing fit tightly in rectangular cutouts disposed on said bottom plate to assist in maintaining collinearity and parallelism of the longitudinal axis of said linear bearings.

11. The active chair according to claim 1, wherein said linear shaft assembly is free to move with respect to the bottom plate assembly facilitating front-to-back displacement.

12. The active chair according to claim 1, wherein said first brake assembly and said second brake assembly are operated by a controller knob of said hand controller.

13. The active chair according to claim 12, wherein turning said controller knob clockwise winds up a high-strength rope that connects to and pulls on a brake lever rope attached to a right and left caliper lever causing rotation, said rotation causes a linear displacement towards the center of said brake caliper.

14. The active chair according to claim 13, wherein said right and left caliper levers are the mirror image of each other with said right caliper lever rotating clockwise and said left caliper lever rotating counterclockwise.

15. The active chair according to claim 13, wherein incremental rotation of said controller knob increases the friction between a brake pad housed in each said right and left caliper levers and said transverse beam providing incremental resistance to movement until such frication that disables all movement completely is reached.

16. The active chair according to claim 13, wherein each said right and left caliper levers are held in a neutral non-rotated position by a return spring screw, a return spring, a return spring cap, and a return spring nut, wherein said return spring is in a compressed state and pushes against a caliper body thus forcing said return spring cap in the outward direction.

17. The active chair according to claim 1, wherein the position of each said first and second hand controllers is interchangeable and can be configured based on user preference.

18. The active chair according to claim 12, wherein said controller knob can rotate a full 110 degrees without inducing damage to neither said brake caliper nor said hand controller.

* * * * *